US012276047B2

(12) United States Patent
Liao et al.

(10) Patent No.: US 12,276,047 B2
(45) Date of Patent: Apr. 15, 2025

(54) ALTERNATING COLOR FABRIC

(71) Applicant: Far Eastern New Century Corporation, Taipei (TW)

(72) Inventors: Ruey-Fen Liao, Taoyuan (TW); Hsin-Kai Lai, Taoyuan (TW); I-Chun Tang, Taoyuan (TW); Kuo-Chih Cheng, Taoyuan (TW)

(73) Assignee: Far Eastern New Century Corporation, Taipei (TW)

( * ) Notice: Subject to any disclaimer, the term of this patent is extended or adjusted under 35 U.S.C. 154(b) by 265 days.

(21) Appl. No.: 17/934,209

(22) Filed: Sep. 22, 2022

(65) Prior Publication Data

US 2024/0102210 A1 Mar. 28, 2024

(51) Int. Cl.

| | |
|---|---|
| ***D03D 15/54*** | (2021.01) |
| ***D02G 3/34*** | (2006.01) |
| ***D02G 3/40*** | (2006.01) |

(52) U.S. Cl.

CPC ..... *D02G 3/404* (2013.01); *D02G 3/346* (2013.01); *D03D 15/54* (2021.01); *D10B 2403/033* (2013.01)

(58) Field of Classification Search

CPC ..... D02G 3/404; D03D 15/54

See application file for complete search history.

(56) References Cited

U.S. PATENT DOCUMENTS

| | | | | | |
|---|---|---|---|---|---|
| 793,524 | A * | 6/1905 | Hewett | D03D 11/00 | 139/384 R |
| 4,837,065 | A * | 6/1989 | Dow | B29C 70/24 | 428/92 |
| 5,041,324 | A * | 8/1991 | Siegling | D03D 11/02 | 428/167 |
| 5,143,569 | A * | 9/1992 | Gotoh | D03D 27/00 | 156/72 |
| 2019/0365000 | A1 | 12/2019 | Simmons et al. | | |
| 2021/0059333 | A1 | 3/2021 | Giorgini | | |
| 2021/0156057 | A1 | 5/2021 | Ogata et al. | | |

FOREIGN PATENT DOCUMENTS

| | | | |
|---|---|---|---|
| CN | 101370978 | A | 2/2009 |
| CN | 102465457 | A | 5/2012 |
| CN | 103172816 | A | 6/2013 |
| CN | 105088826 | A | 11/2015 |
| CN | 204845003 | U | 12/2015 |
| CN | 106418779 | A | 2/2017 |
| CN | 207128365 | U | 3/2018 |
| CN | 208362591 | U | 1/2019 |
| CN | 109371680 | A | 2/2019 |
| CN | 110447984 | A | 11/2019 |
| CN | 112153914 | A | 12/2020 |
| CN | 113134267 | A | 7/2021 |

(Continued)

*Primary Examiner* — Andrew T Piziali

(74) *Attorney, Agent, or Firm* — CKC & Partners Co., LLC

(57) ABSTRACT

An alternating color fabric includes a base portion woven by first yarns, a pleat portion woven by second yarns, and a hydrophilic resin layer formed on the pleat portion. A water contact angle of the hydrophilic resin layer is not more than 60 degrees. The base portion presents a primary color, and the pleat portion presents a secondary color, and the primary color is different from the secondary color.

17 Claims, 16 Drawing Sheets
(7 of 16 Drawing Sheet(s) Filed in Color)

(56) References Cited

FOREIGN PATENT DOCUMENTS

| | | | |
|---|---|---|---|
| EP | 3801096 | A1 | 4/2021 |
| JP | 2020125567 | A | 8/2020 |
| JP | 2021518886 | A | 8/2021 |
| JP | 2021130898 | A | 9/2021 |
| JP | 2021152139 | A | 9/2021 |
| TW | 271455 | B | 1/2007 |
| TW | M503318 | U | 6/2015 |
| TW | 201615910 | A | 5/2016 |
| TW | M522969 | U | 6/2016 |
| TW | M568607 | U | 10/2018 |
| TW | 202002829 | A | 1/2020 |
| WO | 2019231507 | A1 | 12/2019 |

* cited by examiner

ALTERNATING COLOR FABRIC

BACKGROUND

Field of Invention

The present disclosure relates to an alternating color fabric.

Description of Related Art

With development of science and technology, application of textiles in daily life has begun to expand from a field of clothing to other fields. The application of the textiles is more flexible, and various functional fabrics are constantly coming out, for example, the functional fabrics with specific purposes such as moisture absorption, quick drying, comfort, water washing resistance, appearance change, etc.

For example, U.S. patent application Ser. No. 16/275,593 discloses a breathable garment. The garment defines a scope of a torso and is designed with flaps connected to the torso, in which the flaps are woven by two-component yarns made of polyamide and polyester. After the flaps absorb moisture, the two-component yarns become wavy and warped due to deformation; in addition, by designing different colors on front and back of the flaps, after the human torso is sweating, the moisture-absorbing flaps are warped to produce visual color changes of clothing. However, U.S. Ser. No. 16/275,593 is still limited by degree of flap warping, and still has disadvantages of insignificant visual changing effect and a limited visual angle of color rendering, and cannot achieve visual changing effect of color rendering with a wide field of view. It also does not teach how to pass water washing resistance and chlorine resistance test specifications.

Taiwan Patent Publication No. 202002829A discloses a knitted fabric with flaps, which is the knitted fabric with the flaps including a ground weave and flap parts. The flap parts contain composite fibers having a polyester component and a polyamide component joined in side-by-side or eccentric core-sheath configuration, thereby allowing the flap parts to move when wet. However, design of the flap parts fails to provide visual color alternating effect, and the design of the flap parts cannot obtain visual color alternating with a wide field of view. It also does not teach how to pass the water washing resistance and chlorine resistance test specifications.

Taiwan Patent Application No. TW201615910A discloses a color-changing fabric. The surface yarn and the inner yarn loop are connected in series by means of knitting yarn loops. It needs to be pulled by external force and look down the surface of the fabric from the front position of the fabric, and then the color of the inner yarn partially revealed from the surface region of the fabric can be seen, so there are still disadvantages such as insignificant alternating color effect and limited color rendering angle.

Another fabric uses a light and soft non-woven material to make a wave-like foldable structure, but the non-woven material itself is not strong enough, not elastic enough, and cannot withstand washing, and the application is also limited.

SUMMARY

An embodiment of the present disclosure provides an alternating color fabric, which includes a base portion woven by first yarns, a pleat portion woven by second yarns, and a hydrophilic resin layer disposed on the pleat portion.

The base portion and the pleat portion are liftable connected by a connecting portion. The pleat portion at least partially covers the base portion. A water contact angle of the hydrophilic resin layer is not more than 60 degrees. The base portion presents a primary color, and the pleat portion presents a secondary color, and the primary color is different from the secondary color.

In some embodiments, the pleat portion includes an exterior outer facing side and an exterior inner facing side that are connected, the exterior inner facing side faces the base portion, and the hydrophilic resin layer is coated on the exterior outer facing side.

In some embodiments, the pleat portion includes an exterior outer facing side and an exterior inner facing side that are connected, the exterior inner facing side faces the base portion, and the hydrophilic resin layer is coated on the exterior inner facing side.

In some embodiments, the pleat portion includes an exterior outer facing side and an exterior inner facing side that are connected, the exterior inner facing side faces the base portion, and the hydrophilic resin layer is coated on both the exterior inner facing side and the exterior outer facing side.

In some embodiments, the pleat portion completely covers the base portion.

In some embodiments, the base portion is partially exposed from the pleat portion.

In some embodiments, the alternating color fabric has a color rendering angle in a horizontal field of view up to 170 degrees.

In some embodiments, the alternating color fabric has a color rendering angle in a vertical field of view up to 120 degrees.

In some embodiments, a surface coverage ratio of the hydrophilic resin layer on the pleat portion is in a range of 10% to 99%.

In some embodiments, resin of the hydrophilic resin layer comprises polyurethane resin, in which a content of hard segments of the polyurethane resin accounts for 11-40 wt % of a total composition.

In some embodiments, resin of the hydrophilic resin layer comprises polyurethane resin having isocyanate groups, in which the isocyanate groups has a content not more than 6 wt % including 0-6 wt % before curing reaction.

In some embodiments, the alternating color fabric has a color rendering variable area of 2% to 40% after water washed for 20 cycle times.

In some embodiments, the alternating color fabric has a color rendering variable area of 2% to 40% following the AATCC 162-2002 Test Method.

Another embodiment of the present disclosure provides an alternating color fabric, which includes a base portion woven by first yarns, a pleat portion woven by second yarns, and a hydrophilic polymer layer disposed on the pleat portion. The pleat portion and the base portion are formed from hot pressing one greige fabric, and the pleat portion and the base portion are liftable and connected without any connecting portion. A water contact angle of the hydrophilic resin layer is not more than 60 degrees. The base portion presents a primary color, and the pleat portion presents a secondary color, and the primary color is different from the secondary color.

In some embodiments, the hydrophilic resin layer has a pattern that is formed continuously.

In some embodiments, the hydrophilic resin layer has a plurality of solid type or hollow type discontinuous patterns, and the solid type or hollow type discontinuous patterns are dots, lines, stripes, squares, circles, ellipses, polygons, irregular patterns, or combinations thereof.

In some embodiments, the hydrophilic resin layer presents a third color, and the third color is different from the primary color.

In some embodiments, the hydrophilic resin layer presents a third color, and the third color is different from the secondary color.

Another embodiment of the present disclosure provides an alternating color fabric, which includes a base portion and a hydrophilic resin layer disposed on one or both sides of the base portion. A water contact angle of the hydrophilic resin layer less than 60 degrees. The base portion woven by at least one kind of yarns. When the base portion is woven by one kind of yarns, a printing coating layer is further formed on a surface of the hydrophilic resin layer or a surface of the base portion. When the base portion is woven by two or more kinds of yarns, the yarns have two or more colors. Color of the yarns of the base portion, color of the hydrophilic resin layer, and color of the printing coating layer are similar or different, and a coverage ratio of the hydrophilic resin layer on the base portion is in a range of 1% to 99%.

In some embodiments, the printing coating layer formed on the surface of the hydrophilic resin layer partially covers an upper or lower side of the hydrophilic resin layer.

In some embodiments, a color rendering pattern of the alternating color fabric is consistent with a coating pattern of the hydrophilic resin layer on the base portion.

The present disclosure provides the alternating color fabric coated with the hydrophilic resin layer on the fabric, which has wide color rendering angles in the vertical field of view or in the horizontal field of view and good visual changing effect, and can pass the water washing resistance and chlorine resistance test specifications.

BRIEF DESCRIPTION OF THE DRAWINGS

The patent or application file contains at least one drawing executed in color. Copies of this patent or patent application publication with color drawing(s) will be provided by Office upon request and payment of the necessary fee. The disclosure can be more fully understood by reading the following detailed description of the embodiment, with reference made to the accompanying drawings as follows.

DETAILED DESCRIPTION

The following will clearly illustrate spirit of the present disclosure with drawings and detailed descriptions. The person having ordinary skill in the art after understanding the preferred embodiments of the present disclosure can change and modify techniques taught in the present disclosure without departing from the spirit and scope of the present disclosure.

The present disclosure provides a fabric that has obvious visual color alternating effect and can improve wear air permeability. In particular, the present disclosure provides a fabric that can pass Test Method for Colorfastness to Water: Chlorinated Pool (AATCC162-2002), usually referring to a fabric in an environment with chlorine content of less than or equal to 100 ppm can still maintain with significant visual color alternating effect. The related application fields can be extended to beaches, swimming pools, hot springs or playing in the water, such as swimsuits, beach playing clothes, toys or teaching utensils. The alternating color fabric disclosed in the present disclosure is not limited to a pattern used in fabric design, nor is it limited to a kind of a raw material of fabric yarns or dyeing and finishing processes. It can be flexibly adjusted according to functional requirements of the purpose of use.

The present disclosure provides an alternating color fabric, and a weight ratio of soft and hard segments of a hydrophilic resin combined with the fabric must be reasonably matched with an isocyanate group content to achieve a color alternating effect and pass washing resistance and chlorine resistance tests, which cannot be achieved by simple design or simple replacement.

Figure 1:
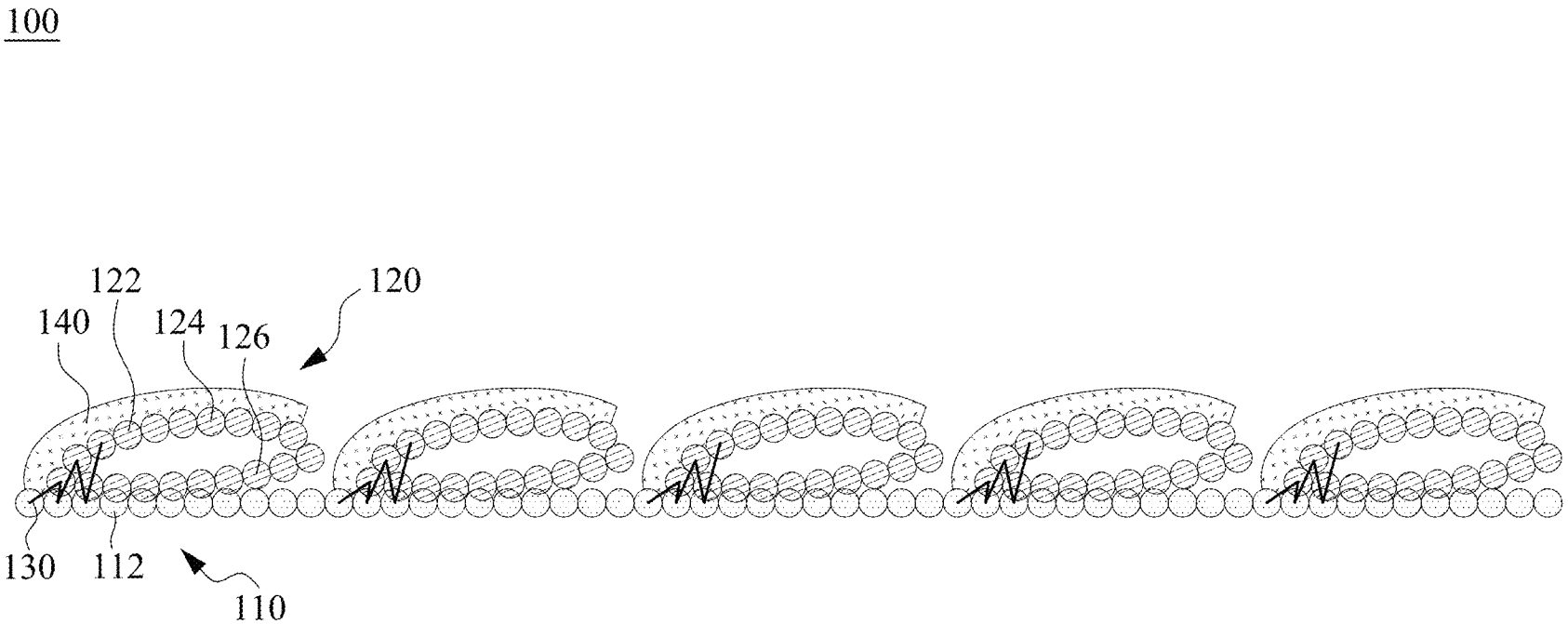
FIGS. 1, 2A, and 2B are partial side views of an alternating color fabric in different states of an embodiment of the present disclosure, respectively.
Figure 2A:
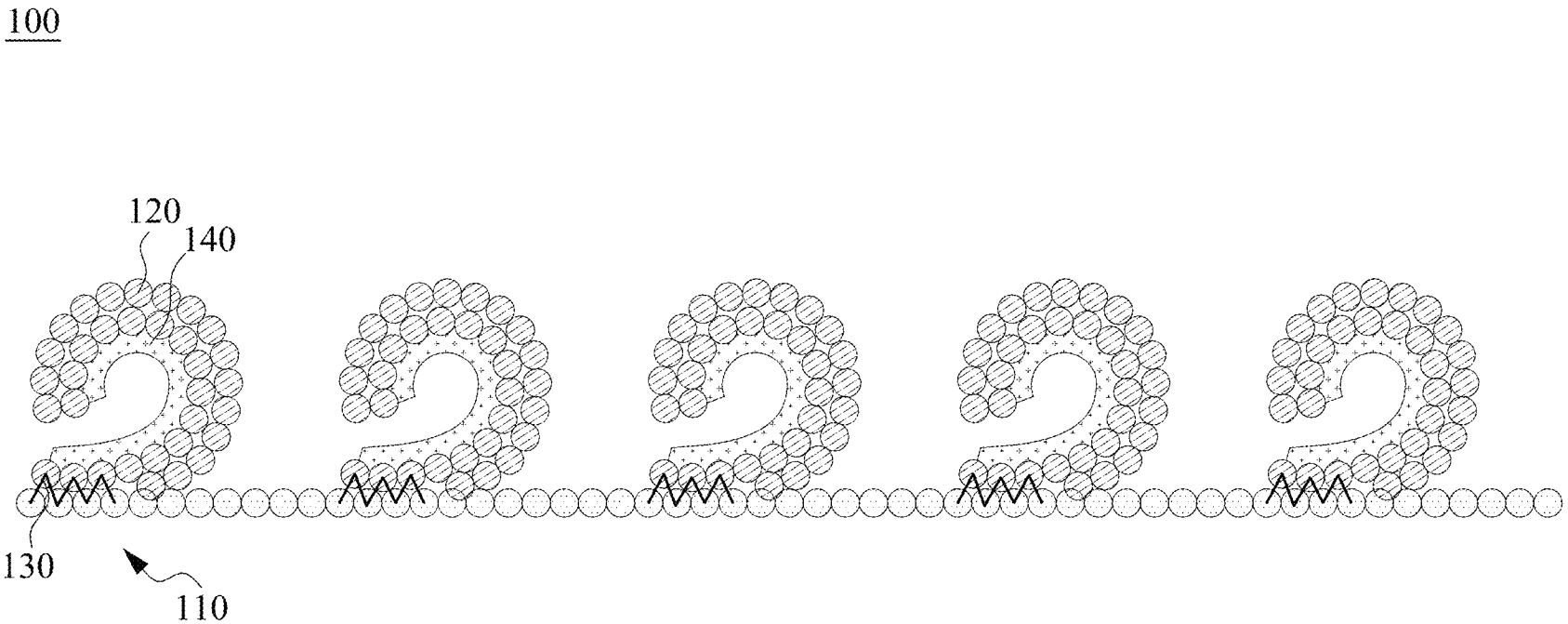
Figure 2B:
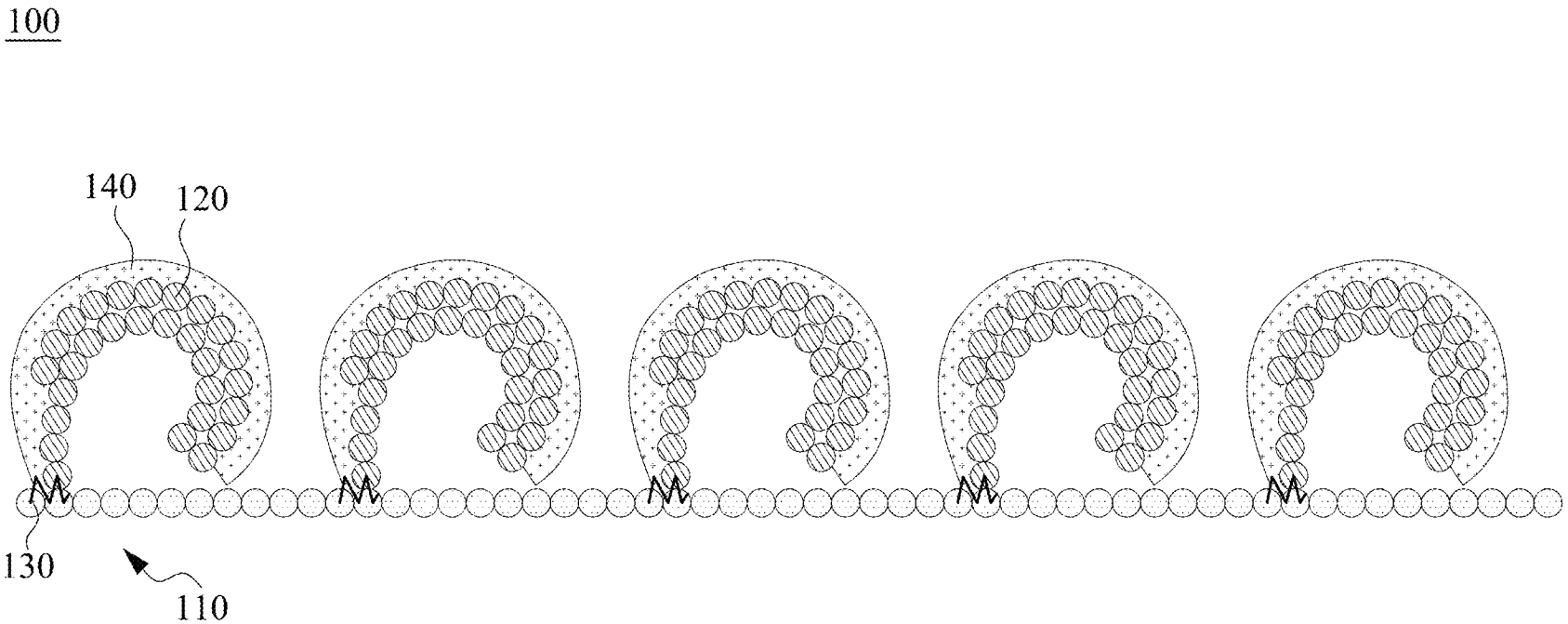

Referring to FIGS. 1, 2A, and 2B, which are partial side views of an alternating color fabric in different states of an embodiment of the present disclosure, respectively. The alternating color fabric 100 includes a base portion 110, a pleat portion 120, and a connecting portion 130 for connecting the base portion 110 and the pleat portion 120, in which the base portion 110 is woven by first yarns 112, and the pleat portion 120 is woven by second yarns 122. The pleat portion 120 at least partially covers the base portion 110. The base portion 110 and the pleat portion 120 are liftable connected by the connecting portion 130, that is, the pleat portion 120 can optionally be substantially flat against the base portion 110 or has a lifting angle relative to the base portion 110.

The alternating color fabric 100 further includes a hydrophilic resin layer 140 formed on the pleat portion 120. After the hydrophilic resin layer 140 absorbs moisture, its molecular structure changes and thus its shape changes. As such, the pleat portion 120 combined with the hydrophilic resin layer 140 is curled accordingly, and the base portion 110 originally covered by the pleat portion 120 is exposed. Also, a yarn coverage area of the fabric is reduced and thus air permeability is increased since the pleat portion 120 is curled.

The pleat portion 120 presents a primary color, and the base portion 110 presents a secondary color, and the primary color is different from the secondary color. As shown in FIG. 1, when the hydrophilic resin layer 140 has not absorbed moisture, the pleat portion 120 is substantially flat against the base portion 110, and most of the base portion 110 is covered by the pleat portion 120. Therefore, the alternating color fabric 100 at this time presents a color of an appearance surface of the pleat portion 120.

Next, as shown in FIGS. 2A and 2B, after the hydrophilic resin layer 140 absorbs moisture, its molecular structure changes and thus its shape changes, which causes the pleat portion 120 combined therewith to curl, and thus the base portion 110 with a different color can be revealed, and a visual color of the fabric 100 is changed.

In some embodiments, as shown in FIG. 2A, after the hydrophilic resin layer 140 absorbs moisture, its molecular structure changes and thus its shape changes, which causes the pleat portion 120 combined therewith curl outwardly. In other embodiments, the pleat portion 120 combined therewith curls inwardly. Therefore, the hydrophilic resin layer 140 can determine whether the pleat portion combined therewith curls outwardly or inwardly according to a ratio of its components.

Preferably, a water contact angle of the hydrophilic resin layer 140 is not more than 60 degrees. The hydrophilic resin layer 140 includes 11 wt % to 40 wt % of polyurethane hard segments, and before curing reaction, includes not more than 6 wt % (including 0 to 6 wt %) of isocyanate groups. In some embodiments, the polyurethane hard segments in the hydrophilic resin layer 140 may be 11 wt % to 16 wt %, 16 wt % to 22 wt %, 22 wt % to 28 wt %, 28 wt % to 34 wt %, or 34 wt % to 40 wt %. For example, the polyurethane hard segments in the hydrophilic resin layer 140 may be 11 wt %, 12 wt %, 13 wt %, 14 wt %, 15 wt %, 16 wt %, 17 wt %, 18 wt %, 19 wt %, 20 wt %, 21 wt %, 22 wt %, 23 wt %, 24 wt %, 25 wt %, 26 wt %, 27 wt %, 28 wt %, 29 wt %, 30 wt %, 31 wt %, 32 wt %, 33 wt %, 34 wt %, 35 wt %, 36 wt %, 37 wt %, 38 wt %, 39 wt %, or 40 wt %. In some embodiments, the isocyanate groups in the hydrophilic resin layer 140 may be 0 to 6 wt % or 3 to 6 wt % before the curing reaction. For example, the isocyanate groups in the hydrophilic resin layer 140 may be 0 wt %, 1 wt %, 2 wt %, 3 wt %, 4 wt %, 5 wt %, or 6 wt %. If an amount of the polyurethane groups or an amount of the isocyanate groups of measurement is higher than the aforementioned range, viscosity of the hydrophilic resin layer 140 is too high, and it is difficult to print on a surface of the pleat portion 120. If an amount of the polyurethane groups or an amount of the isocyanate groups of measurement is less than the aforementioned range, the hydrophilic resin layer 140 is insufficiently stable after water washing for many cycle times, and it is difficult to achieve the purpose of curling the pleat portion 120, resulting in insignificant changes in the color rendering variable area.

Figure 3:
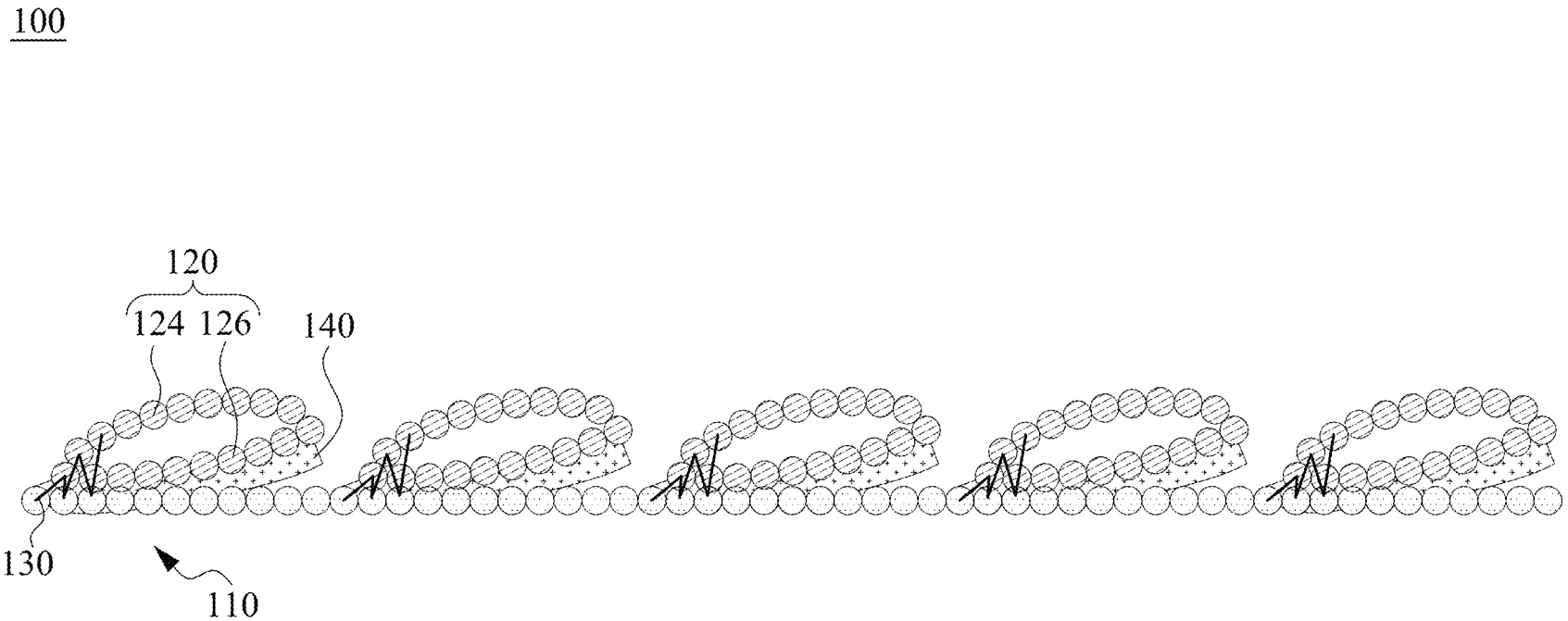
FIGS. 3 and 4 are partial side views of alternating color fabrics of different embodiments of the present disclosure, respectively.
Figure 4:
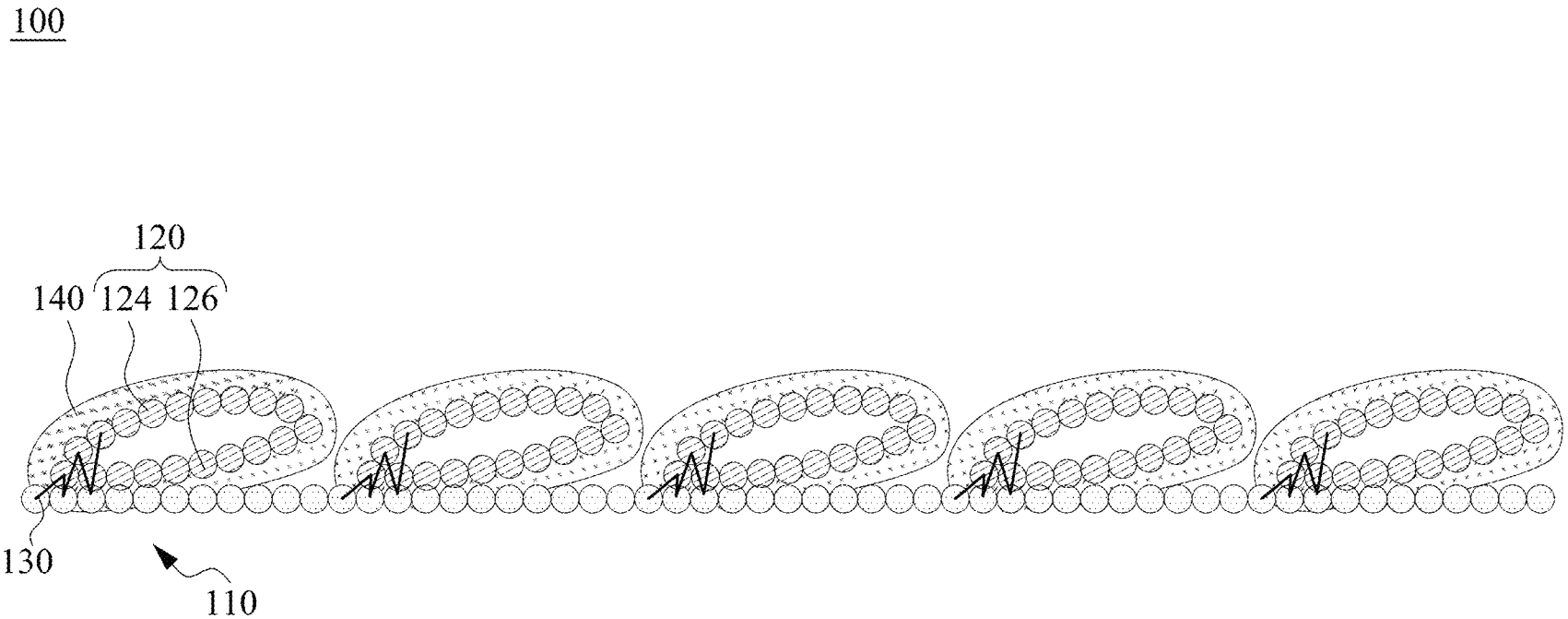

The pleat portion 120 has an exterior outer facing side 124 and an exterior inner facing side 126 that are connected, in which the exterior inner facing side 126 faces the base portion 110, and the exterior outer facing side 124 is the appearance surface of the pleat portion 120. As shown in FIGS. 1, 2A and 2B, the hydrophilic resin layer 140 is formed on the exterior outer facing side 124 of the pleat portion 120. In other embodiments, as shown in FIG. 3, the hydrophilic resin layer 140 may be formed on the exterior inner facing side 126 of the pleat portion 120, or, as shown in FIG. 4, the hydrophilic resin layer 140 may be formed on both the exterior outer facing side 124 and the exterior inner facing side 126 of the pleat portion 120.

In some embodiments, a length of the pleat portion 120 substantially completely covers the base portion 110, more specifically, it completely covers a portion of the base portion 110 that is not overlapped with the connecting portion 130, so that the pleat portion 120 is substantially flat against the base portion 110 when the alternating color fabric 100 has not absorbed moisture, and a clothing pattern seen by the user is presented by the appearance surface of the pleat portion 120. For example, if the length of the pleat portion 120 is 4.5 mm and the length of the connecting portion 130 is 0.5 mm, the length of the portion of the base portion 110 that is not overlapped with the connecting portion 130 is 4.0 mm.

In some other embodiments, a length of the pleat portion 120 is less than a length of the base portion 110, that is, a portion of the base portion 110 that is not overlapped with the connecting portion 130 is partially exposed from the pleat portion 120, so that the pleat portion 120 is substantially flat against the base portion 110 when the alternating color fabric 100 has not absorbed moisture, and a clothing pattern seen by the user is presented by both the appearance surface of the pleat portion 120 and the appearance surface of the base portion 110. For example, if the length of the pleat portion 120 is 4.5 mm and the length of the connecting portion 130 is 0.5 mm, the length of the portion of the base portion 110 that is not overlapped with the connecting portion 130 is less than 4.0 mm.

In some embodiments, the first yarns 112 of the base portion 110 and the second yarns 122 of the pleat portion 120 are yarns with basic strength properties, and their materials may be same or different. Examples of kinds of the first yarns 112 and the second yarns 122 may be natural, artificial, or mixed natural/artificial fibers. The natural fibers include but are not limited to cotton, hemp, wool, silk, etc.; the artificial fibers include but are not limited to polyester, polyethylene terephthalate, polybutylene terephthalate, polyethylene naphthalate, polyamide, polyacrylonitrile, polyurethane, polyvinyl chloride, polyvinyl alcohol, polyolefin, etc. It can be changed arbitrarily according to the purpose of use, and polyester is preferred.

In some embodiments, the hydrophilic resin layer 140 includes, but is not limited to, polyurethane resins generally having isocyanate groups, polyether-based polyurethanes, polyester-based polyurethanes, water-based polyurethanes, solvent-based polyurethanes, non-solvent-based polyurethanes, polyether-based carbamate resin, polyester-based carbamate resin, polyester-polyether-based carbamate resin, polycarbonate-based carbamate resin, etc.

In some embodiments, the color of the first yarns 112 of the base portion 110 may be the color of the colored yarn itself, or the color of the dye through post-dyeing or the color transferred through printing in subsequent dyeing and finishing processes. The color of the second yarns 122 of the pleat portion 120 may be the color of the colored yarn itself, or the color of the dye through post-dyeing or the color transferred through printing in subsequent dyeing and finishing processes. The color of the pleat portion 120 is different from the color of the based portion 110.

It should be noted that the hydrophilic resin layer 140 will be printed on the surface of the pleat portion 120 after the fabric (including the base portion 110, the pleat portion 120 and the connecting portion 130) is dyed and finished, and thus it can prevent the hydrophilic resin layer 140 from contacting the liquid in the dyeing and finishing processes, and therefore can prevent the alternating color fabric 100 from being unnecessarily deformed during the dyeing and finishing processes, and can effectively maintain flatness of the alternating color fabric 100. In some embodiments, the hydrophilic resin layer 140 may have a third color, and the third color of the hydrophilic resin layer 140 is different from the secondary color of the base portion 110 and the primary color of the pleat portion 120.

In some embodiments, the fabric (including the base portion 110, the pleat portion 120 and the connecting portion 130) may be integrally formed by knitting. In some embodiments, the base portion 110 and the pleat portion 120 can be made separately, and the base portion 110 and the pleat portion 120 are connected together through the connecting portion 130, such as stitching. The weaving method of the based portion 110 and pleat portion 120 is not limited to knitting, and may be plain weaving or other suitable weaving methods.

Figure 5:
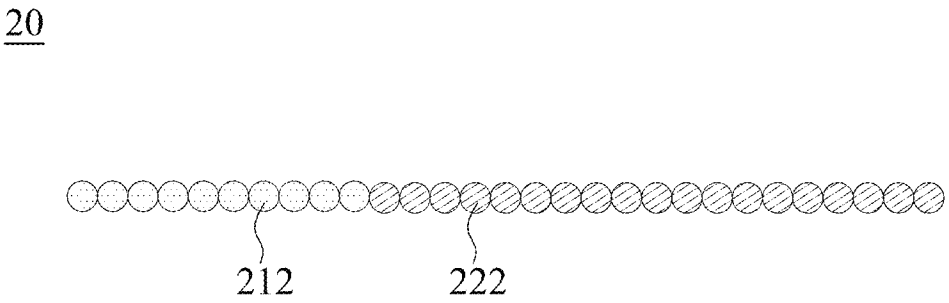
FIGS. 5 to 7 are partial schematic diagrams of an alternating color fabric in different manufacturing stages of another embodiment of the present disclosure.
Figure 6:
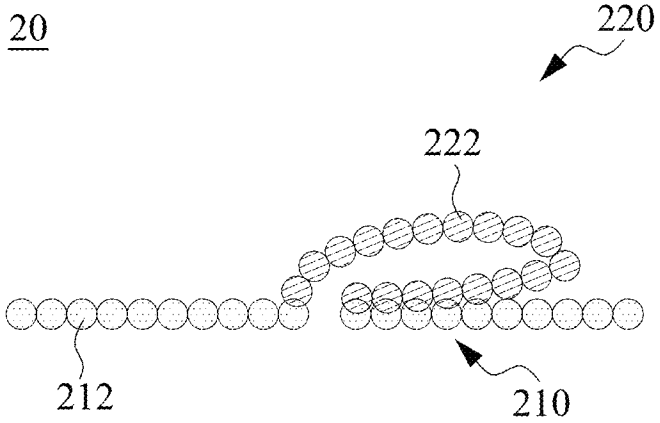
Figure 7:
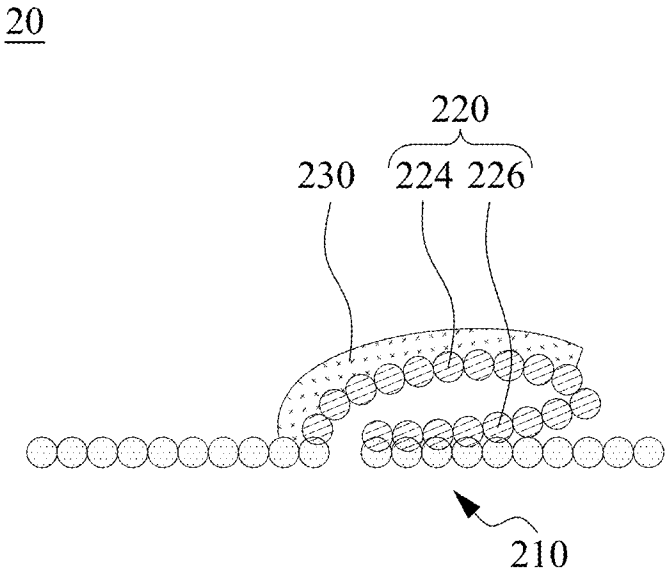

Next, please refer to FIGS. 5 to 7, which are partial schematic diagrams of an alternating color fabric in different manufacturing stages of another embodiment of the present disclosure. First, as shown in FIG. 5, a greige fabric 20 woven by first yarns 212 and second yarns 222 is provided. The first yarns 212 and the second yarns 222 may be arranged in sections. The kinds of the first yarns 212 and the second yarns 222 are as described above, and will not be repeated here. Next, as shown in FIG. 6, a hot pressing process is performed to shape the base portion 210 woven by the first yarns 212 and the pleat portion 220 woven by the second yarns 222. The base portion 210 and the pleat portion 220 are formed from hot pressing the same greige fabric 20, and there is no additional connecting portion or a sewing thread connected between the base portion 210 and the pleat portion 220. Next, a series of dyeing and finishing processes are selectively performed to make required patterns on the base portion 210 and the pleat portion 220. In some embodiments, the pleat portion 220 may completely cover the base portion 210, or, in some other embodiments, a portion of the base portion 210 may be partially exposed from the pleat portion 220.

Next, as shown in FIG. 7, a hydrophilic resin layer 230 is formed on the pleat portion 220. The pleat portion 220 has an exterior outer facing side 224 and an exterior inner facing side 226 opposite to each other. The hydrophilic resin layer 230 may be formed on the exterior outer facing side 224 of the pleat portion 220 or the exterior inner facing side 226 of the pleat portion 220, or on both the exterior outer facing side 224 and the exterior inner facing side 226 of the pleat portion 220. Since the hydrophilic resin layer 230 is printed on a surface of the pleat portion 220 after the greige fabric 20 is dyed and finished, it can prevent the hydrophilic resin layer 230 from contacting the liquid in the dyeing and finishing processes, and therefore can prevent the alternating color fabric 200 from being unnecessarily deformed during the dyeing and finishing processes, and can effectively maintain flatness of the alternating color fabric 200.

The first yarns 212 of the base portion 210 have a secondary color, and the second yarns 222 of the pleat portion 220 have a primary color, and the primary color is different from the secondary color. As mentioned above, when the hydrophilic resin layer 230 has not absorbed moisture, the pleat portion 220 is substantially flat against the base portion 210, and most of the base portion 210 is covered by the pleat portion 220. Therefore, the alternating color fabric 200 at this time presents a color of an appearance surface of the pleat portion 220. After the hydrophilic resin layer 230 absorbs moisture, the molecular structure of the hydrophilic resin changes and thus its shape changes, which causes the pleat portion 220 combined therewith to curl, and thus the base portion 210 with a different color can be revealed, and a visual color of the fabric 200 is changed.

Preferably, the hydrophilic resin layer 230 includes 11 wt % to 40 wt % of polyurethane hard segments, and before a curing reaction, includes not more than 6 wt % (including 0 to 6 wt %) of isocyanate groups. In some embodiments, the polyurethane hard segments in the hydrophilic resin layer 140 may be 11 wt % to 16 wt %, 16 wt % to 22 wt %, 22 wt % to 28 wt %, 28 wt % to 34 wt %, or 34 wt % to 40 wt %. For example, the polyurethane hard segment in the hydrophilic resin layer 140 may be 11 wt %, 12 wt %, 13 wt %, 14 wt %, 15 wt %, 16 wt %, 17 wt %, 18 wt %, 19 wt %, 20 wt %, 21 wt %, 22 wt %, 23 wt %, 24 wt %, 25 wt %, 26 wt %, 27 wt %, 28 wt %, 29 wt %, 30 wt %, 31 wt %, 32 wt %, 33 wt %, 34 wt %, 35 wt %, 36 wt %, 37 wt %, 38 wt %, 39 wt %, or 40 wt %. In some embodiments, the isocyanate groups in the hydrophilic resin layer 140 may be 0 to 6 wt % or 3 to 6 wt % before the curing reaction. For example, the isocyanate groups in the hydrophilic resin layer 140 may be 0 wt %, 1 wt %, 2 wt %, 3 wt %, 4 wt %, 5 wt %, or 6 wt %. If an amount of the polyurethane groups and an amount of the isocyanate reactive functional groups are both outside the aforementioned ranges, viscosity of the hydrophilic resin layer 230 is too high, and it is difficult to print on the surface of the pleat portion 220; therefore, if the amount of the polyurethane groups and the amount of the isocyanate groups of measurement are unable to meet the aforementioned ranges, it may result in excessively high viscosity of the hydrophilic resin layer 230, making it difficult to print on the surface of the pleat portion 220. However, if an amount of the polyurethane groups or an amount of the isocyanate groups of measurement is less than the aforementioned range, the hydrophilic resin layer 230 or the hydrophilic resin layer 230 after water washing for many times is insufficiently stable, and it is difficult to achieve the purpose of curling the pleat portion 220, resulting in insignificant changes in the color rendering variable area.

In some embodiments, the hydrophilic resin layer 230 may have a third color, and the third color of the hydrophilic resin layer 230 is different from the secondary color of the first yarns 212 of the base portion 210 and the primary color of the second yarns 222 of the pleat portion 220.

Referring to FIGS. 8A to 8H, which are partial top views of alternating color fabrics of different embodiments of the present disclosure, respectively. In an alternating color fabric 300, a surface coverage ratio of a hydrophilic resin layer 320 formed on a pleat portion 310 is in a range of 10% to 99%.

In some embodiments, the hydrophilic resin layer 320 is printed on the pleat portion 310 by gravure printing. For example, a molten hydrophilic resin can flow onto a printing roller, and excess hydrophilic resin is then scraped off with a scraper, and the printing roller can then be brought into contact with a surface of a fabric after dyeing and finishing to transfer the hydrophilic resin stored in grooves to the surface of the fabric, and it is adsorbed in cavities or recesses of the surface of the fabric. Finally, the fabric is dried to allow a cross-linking reaction of the hydrophilic resin to be completed and cured, and then the alternating color fabric 300 provided with the patterned hydrophilic resin layer 320 can be obtained.

Figure 8A:
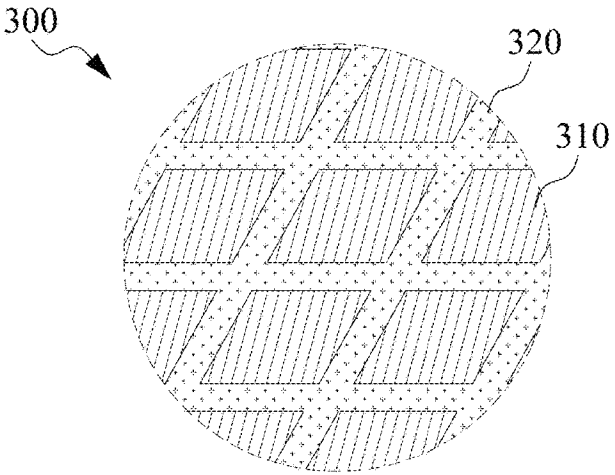
FIGS. 8A to 8H are partial top views of alternating color fabrics of different embodiments of the present disclosure, respectively.
Figure 8B:
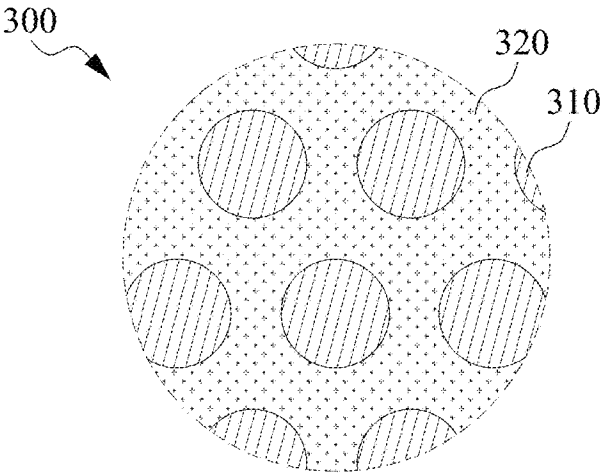
Figure 8C:
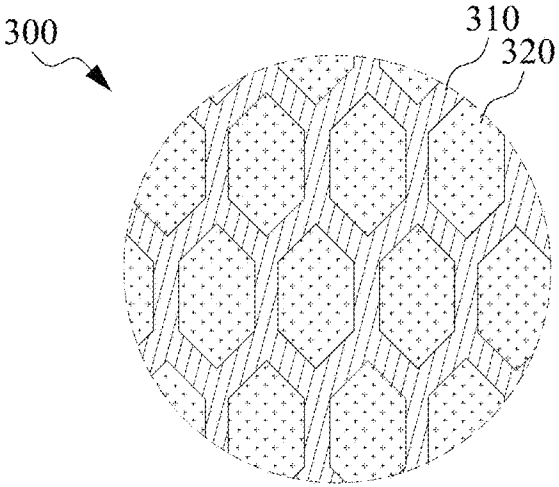
Figure 8D:
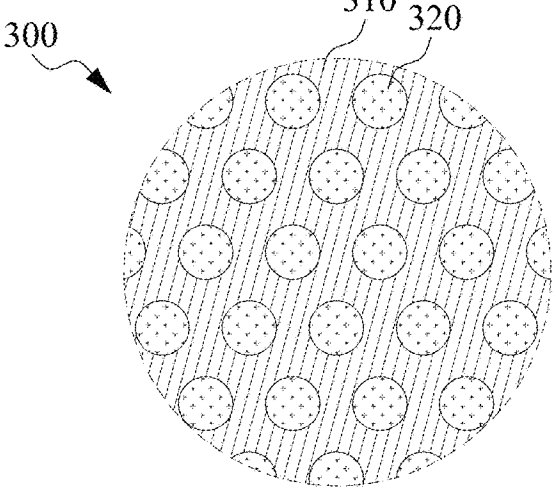
Figure 8E:
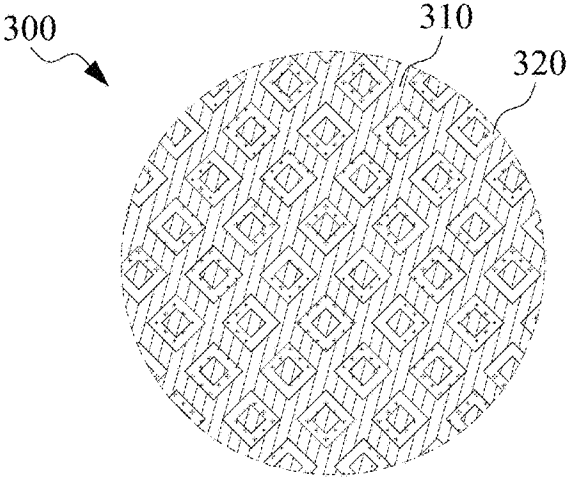
Figure 8F:
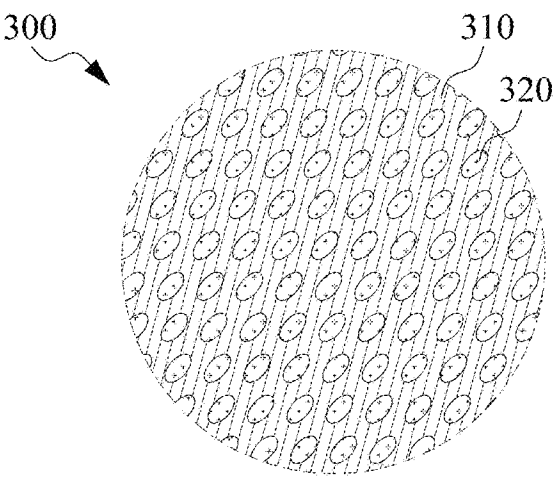
Figure 8G:
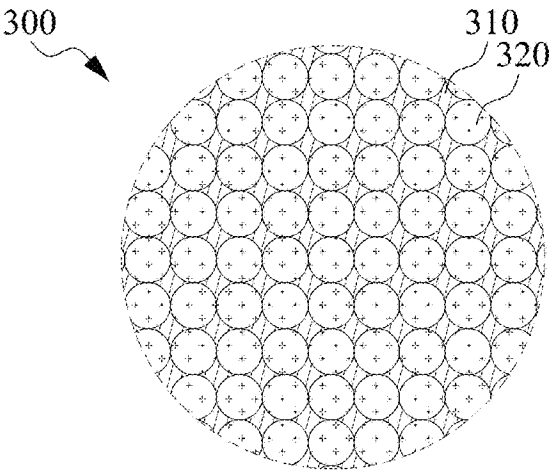
Figure 8H:
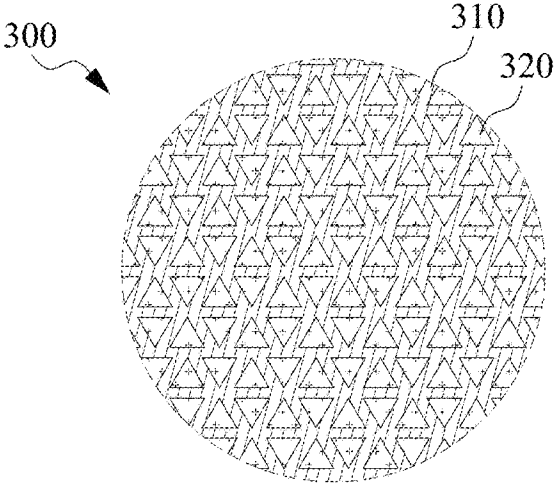

The pattern of the hydrophilic resin layer 320 may be a continuous grid pattern as shown in FIG. 8A, or a continuous block pattern as shown in FIG. 8B. Alternatively, the pattern of the hydrophilic resin layer 320 may have a plurality of solid type or hollow type discontinuous patterns, and the solid type or hollow type discontinuous patterns can be dots, lines, strips, squares, circles, ellipses, polygons, irregular patterns, or combinations thereof, as shown in FIGS. 8C to 8H.

A basic composition structure of the hydrophilic polymer includes a hard segment and a soft segment. The composition and content of the hard segment will affect hydrogen bonding ability in the molecule, degree of microphase separation, and crystalline properties of the overall molecule, and the composition of the soft segment will affect flexibility and hydrophilicity of the overall molecule. Therefore, the molecular composition and the structure of the soft segment and hard segment, the amount and the size of monomers, and a weight ratio of the soft segment and hard segment based on a total amount of the hydrophilic resin are key factors that determine physical properties.

The hydrophilic resin layer used in the alternating color fabric of the present disclosure is composed of polyether polyol or polyester polyol or polycarbonate long-chain polyol or polyether polyamine as the main soft segment structure, and isocyanate groups as the main hard segment structure, and a reaction is carried out to form an isocyanate-terminated (—NCO) prepolymer, and then a hydrophilic resin is formed after aging and curing reaction. Optionally, the polyether or polyester polyol can be crystalline polyol or amorphous polyol, and from the viewpoint of improving hydrophilicity and washing resistance, a weight average molecular weight of the polyether or polyester polyol can be 400-1,000, 800-4,000 or 2,000-8,000. Preferably, the weight average molecular weight of the polyether or polyester polyol ranges from 400 to 8,000. More preferably, the polyether polyol is modified to form ester group-containing polyether polyol, amide group-containing polyether polyol, or any combination thereof. The hydrophilic resin layer used in the fabric has a hard segment with a weight average molecular weight of less than 1,000 and a soft segment connected to the hard segment and with a weight average molecular weight of 400 or more. The soft segment and the hard segment are formed by a polymerization reaction with an isocyanate compound. Optionally, the isocyanate compound may be, but not limited to methyl isocyanate, toluene diisocyanate, methylene diphenyl diisocyanate (MDI), xylyl diisocyanate (XDI), toluene diisocyanate (TDI), isophorone diisocyanate (IPDI), hexamethylene diisocyanate (HDI), methylidintri-p-phenylen triisocyanate, 4,4'-methylenebis cyclohexyl isocyanate (HMDI), 2,2'-dimethyldiphenylmethane-3,3',5,5'-tetraisocyanate, or poly methylene phenyl isocyanate, etc.

Furthermore, the composition of the hard segment includes a short chain alcohol, a low molecular weight chain extender or a crosslinking agent, optionally, the short chain alcohol may be used alone or in combination, and the short chain alcohol may be, but not limited to the group selected from ethylene glycol, 1,4-butanediol, 1,6-hexanediol, diethyl ethylene glycol, triethylene glycol, propylene glycol, butylene glycol, diethylene glycol, neopentyl glycol and glycerol, and optionally, the low molecular weight chain extender or the crosslinking agent may be selected from ethylenediamine, triethylamine, n-butylamine, ethanolamine and trimethylolpropane (TMP).

The hydrophilic resin synthesis reaction may be carried out in a melt or a solution, and a side reaction caused by a high temperature must be avoided during the reaction in the melt. Viscosity will gradually increase during the reaction process. It is necessary to avoid an incomplete reaction caused by insufficient stirring, or excessively high viscosity caused by the reaction too fast to make the resin unusable. The hydrophilic resin synthesis reaction roughly includes two steps: performing prepolymerization reaction and chain extension reaction. Isocyanate and long chain polyol form oligomers containing isocyanate end group —N═C═O through the prepolymerization reaction. The molecular structure changes from a linear structure to a three-dimensional structure through the chain extension reaction. Due to different reaction conditions, different contents of isocyanate groups and weight ratios of the soft and hard segments of the compounds, structures of the hydrophilic resins are very different, so degrees of hydrophilicity are different. Hydrophilicity is determined by a water contact angle (θ) test value. A conventional measurement method of the water contact angle is to apply a hydrophilic resin layer to a flat solid surface (e.g., glass) for measurement. When a liquid (e.g., a water droplet) is in contact with the flat solid surface, an angle between a liquid surface and the solid surface (the angle inside the liquid) is observed, which is called the contact angle and is a kind of affinity with water (wettability). The surface is super hydrophilic when the contact angle is 10 degrees or less, and is strongly hydrophilic when the contact angle is 10-30 degrees, and is generally hydrophilic when the contact angle is 30-60 degrees, and is hydrophobic when the contact angle is 90-120 degrees.

But in fact, the hydrophilic resin layer used in the alternating color fabric will change its shape due to volume swelling after infiltration, especially a height change of a surface of the resin layer, sometimes surface curling or surface extrusion due to stress generated by volume shrinkage, sometimes local elevation or local depression due to single-point expansion of the resin layer plane. All of which make the hydrophilic resin layer unable to continuously maintain flatness of the surface, resulting in a surface roughness, so errors may occur in the measurement of the water contact angle. But in general terms, when water comes into contact with the hydrophilic resin layer, it will be quickly absorbed and dissipated, and completely wetting the surface of the hydrophilic resin layer, or it will enter the interior of the hydrophilic resin layer (usually within 30 seconds), causing the resin layer to change its shape and the surface protrusion or surface depression of the resin layer contacted by the observation water droplet, so the angle change cannot be observed. In this situation, it is determined that the water contact angle of the hydrophilic resin is less than 10 degrees, which is super hydrophilic; if the water droplet on the surface of the hydrophilic resin layer produces a change in the contact angle from large to small, the difference in the angle change is determined as having the water contact angle between 30 and 60 degrees. When the water is absorbed relatively quickly (the angle from large to small changes quickly, usually within 1 minute), the water contact angle is determined to be 30 degrees, which is strongly hydrophilic; when the water is absorbed relatively slowly (the angle from large to small changes slowly, usually within 1 to 3 minutes), but it can still be observed that the water is gradually absorbed, the water contact angle is determined to be 60 degrees, which is generally hydrophilic.

The composition structure and the dosage ratio of the soft and group of the hydrophilic resin layer used in the alternating color fabric of the present disclosure can be appropriately changed according to visual color change requirements of the matched fabric, but the hydrophilic resin layer must meet requirements of including 11 wt % to 40 wt % of the polyurethane hard segments and not more than 6 wt % (including 0 to 6 wt %) of the isocyanate groups after the polymerization reaction and measured before the curing reaction, otherwise the prepared fabric is difficult to pass the water washing test and thus fails to be used in practice.

In some embodiments, the polyurethane hard segments in the hydrophilic resin layer 140 may be 11 wt % to 16 wt %, 16 wt % to 22 wt %, 22 wt % to 28 wt %, 28 wt % to 34 wt %, or 34 wt % to 40 wt %. For example, the polyurethane hard segments in the hydrophilic resin layer 140 may be 11 wt %, 12 wt %, 13 wt %, 14 wt %, 15 wt %, 16 wt %, 17 wt %, 18 wt %, 19 wt %, 20 wt %, 21 wt %, 22 wt %, 23 wt %, 24 wt %, 25 wt %, 26 wt %, 27 wt %, 28 wt %, 29 wt %, 30 wt %, 31 wt %, 32 wt %, 33 wt %, 34 wt %, 35 wt %, 36 wt %, 37 wt %, 38 wt %, 39 wt %, or 40 wt %. In some embodiments, the isocyanate groups in the hydrophilic resin layer 140 may be 0 to 6 wt % or 3 to 6 wt % before the curing reaction. For example, the isocyanate groups in the hydrophilic resin layer 140 may be 0 wt %, 1 wt %, 2 wt %, 3 wt %, 4 wt %, 5 wt %, or 6 wt %.

Hereinafter, preparation methods of each example and each comparative example are disclosed to further describe features and effects of the present disclosure. It should be understood that, without going beyond the scope of the present disclosure, materials used, their amounts and proportions, processing details, and processing procedures may be appropriately changed. Therefore, the present disclosure should not be interpreted restrictively by the preparation methods described below.

The preparation method of Examples 1 to 18 and Comparative Examples 1 to 7 is as follows. Soft segment constituent materials and hard segment constituent materials used in the experiment were added into a reaction vessel and uniformly mixed, and a temperature rise reaction was carried out until a content of isocyanate groups reached a set target value of the composition, and a hydrophilic layer resin was obtained. The specific implementation manner is shown in Table 1 below.

TABLE 1

| Preparation method | | Examples 1 to 18 Melt dispersion | Comparative Examples 1-2 and 6-7 Melt dispersion | Comparative Examples 3-5 Solvent dispersion |
|---|---|---|---|---|
| Soft segment | Optional long chain polyol, polyamine | Polyether polyol, polyester polyol, polycarbonate polyol, polyether polyamine, used alone or in combination. | | |
| Hard segment | Optional short chain polyol, optional isocyanate, and optional chain extender or crosslinker | Ethylene glycol, 1,4-butanediol, 1,6-hexanediol, diethyl ethylene glycol, triethylene glycol, propylene glycol, butylene glycol, diethylene glycol, neopentyl glycol, glycerol, ethylenediamine, triethylamine, n-butylamine, ethanolamine, trimethylolpropane, used alone or in combination. | | |
| | | Isocyanate compounds, such as: TDI, MDI, HDI, HMDI, IPDI, XDI, used alone or in combination. | | |
| Reactor | | Stirred | Stirred | Stirred |
| Reaction temperature | | 50° C.-130° C. | 50° C.-130° C. | 50° C.-130° C. |
| Dispersed substance | | Prepolymer melt | Prepolymer melt | Distilled water or organic solvent |
| Post-dispersion reaction step | | Polymerization | Polymerization | Polymerization |
| Aging curing temperature | | 30° C.-100° C. | 30° C.-100° C. | — |

Example 1-Resin 1

Resin 1 was a solvent-free polyurethane resin and polymerized in a melt state. After the polymerization reaction was completed, the polyurethane hard segments were 12.11 wt %, and before the curing reaction, the isocyanate groups were 3.63 wt %. Resin 1 formed a film layer after the aging curing reaction, and film wettability was 250-400%, and a water contact angle was less than 10 degrees (water was quickly absorbed and dissipated on the film surface), which was super hydrophilic.

Example 2-Resin 2

Resin 2 was a solvent-free polyurethane resin and polymerized in a melt state. After the polymerization reaction was completed, the polyurethane hard segments were 11.02 wt %, and before the curing reaction, the isocyanate groups were 2.72 wt %. Resin 2 formed a film layer after the aging curing reaction, and film wettability was 250-400%, and a water contact angle was less than 10 degrees (water was quickly absorbed and dissipated on the film surface), which was super hydrophilic.

Example 3-Resin 3

Resin 3 was a solvent-free polyurethane resin and polymerized in a melt state. After the polymerization reaction was completed, the polyurethane hard segments were 15.24 wt %, and before the curing reaction, the isocyanate groups were 3.81 wt %. Resin 3 formed a film layer after the aging curing reaction, and film wettability was 250-400%, and a water contact angle was less than 10 degrees (water was quickly absorbed and dissipated on the film surface), which was super hydrophilic.

Example 4-Resin 4

Resin 4 was a solvent-free polyurethane resin and polymerized in a melt state. After the polymerization reaction was completed, the polyurethane hard segments were 12.21 wt %, and before the curing reaction, the isocyanate groups were 4.21 wt %. Resin 4 formed a film layer after the aging curing reaction, and film wettability was 250-400%, and a water contact angle was less than 10 degrees (water was quickly absorbed and dissipated on the film surface), which was super hydrophilic.

Example 5-Resin 5

Resin 5 was a solvent-free polyurethane resin and polymerized in a melt state. After the polymerization reaction was completed, the polyurethane hard segments were 19.95 wt %, and before the curing reaction, the isocyanate groups were 3.03 wt %. Resin 5 formed a film layer after the aging curing reaction, and film wettability was 250-400%, and a water contact angle was less than 10 degrees (water was quickly absorbed and dissipated on the film surface), which was super hydrophilic.

Example 6-Resin 6

Resin 6 was a solvent-free polyurethane resin and polymerized in a melt state. After the polymerization reaction was completed, the polyurethane hard segments were 11.94 wt %, and before the curing reaction, the isocyanate groups were 5.09 wt %. Resin 6 formed a film layer after the aging curing reaction, and film wettability was 250-400%, and a water contact angle was less than 10 degrees (water was quickly absorbed and dissipated on the film surface), which was super hydrophilic.

Example 7-Resin 7

Resin 7 was a solvent-free polyurethane resin and polymerized in a melt state. After the polymerization reaction was completed, the polyurethane hard segments were 21.95 wt %, and before the curing reaction, the isocyanate groups were 5.51 wt %. Resin 7 formed a film layer after the aging curing reaction, and film wettability was 150-250%, and a water contact angle was less than 30 degrees (water droplet contact angle changed rapidly from large to small), which was strongly hydrophilic.

Example 8-Resin 8

Resin 8 was a solvent-free polyurethane resin and polymerized in a melt state. After the polymerization reaction was completed, the polyurethane hard segments were 20.40 wt %, and before the curing reaction, the isocyanate groups were 3.18 wt %. Resin 8 formed a film layer after the aging curing reaction, and film wettability was 150-250%, and a water contact angle was less than 30 degrees (water droplet contact angle changed rapidly from large to small), which was strongly hydrophilic.

Example 9-Resin 9

Resin 9 was a solvent-free polyurethane resin and polymerized in a melt state. After the polymerization reaction was completed, the polyurethane hard segments were 20.40 wt %, and before the curing reaction, the isocyanate groups were 3.26 wt %. Resin 9 formed a film layer after the aging curing reaction, and film wettability was 150-250%, and a water contact angle was less than 30 degrees (water droplet contact angle changed rapidly from large to small), which was strongly hydrophilic.

Example 10-Resin 10

Resin 10 was a solvent-free polyurethane resin and polymerized in a melt state. After the polymerization reaction was completed, the polyurethane hard segments were 20.50 wt %, and before the curing reaction, the isocyanate groups were 3.52 wt %. Resin 10 formed a film layer after the aging curing reaction, and film wettability was 150-250%, and a water contact angle was less than 30 degrees (water droplet contact angle changed rapidly from large to small), which was strongly hydrophilic.

Example 11-Resin 11

Resin 11 was a solvent-free polyurethane resin and polymerized in a melt state. After the polymerization reaction was completed, the polyurethane hard segments were 18.30 wt %, and before the curing reaction, the isocyanate groups were 3.04 wt %. Resin 11 formed a film layer after the aging curing reaction, and film wettability was 150-250%, and a water contact angle was less than 30 degrees (water droplet contact angle changed rapidly from large to small), which was strongly hydrophilic.

Example 12-Resin 12

Resin 12 was a solvent-free polyurethane resin and polymerized in a melt state. After the polymerization reaction was completed, the polyurethane hard segments were 18.78 wt %, and before the curing reaction, the isocyanate groups were 4.50 wt %. Resin 12 formed a film layer after the aging curing reaction, and film wettability was 150-250%, and a water contact angle was less than 30 degrees (water droplet contact angle changed rapidly from large to small), which was strongly hydrophilic.

Example 13-Resin 13

Resin 13 was a solvent-free polyurethane resin and polymerized in a melt state. After the polymerization reaction was completed, the polyurethane hard segments were 21.91 wt %, and before the curing reaction, the isocyanate groups were 5.40 wt %. Resin 13 formed a film layer after the aging curing reaction, and film wettability was 50-150%, and a water contact angle was less than 60 degrees (water droplet contact angle changed gradually from large to small), which was generally hydrophilic.

Example 14-Resin 14

Resin 14 was a solvent-free polyurethane resin and polymerized in a melt state. After the polymerization reaction was completed, the polyurethane hard segments were 24.91 wt %, and before the curing reaction, the isocyanate groups were 2.74 wt %. Resin 14 formed a film layer after the aging curing reaction, and film wettability was 50-150%, and a water contact angle was less than 60 degrees (water droplet contact angle changed gradually from large to small), which was generally hydrophilic.

Example 15-Resin 15

Resin 15 was a solvent-free polyurethane resin and polymerized in a melt state. After the polymerization reaction was completed, the polyurethane hard segments were 24.97 wt %, and before the curing reaction, the isocyanate groups were 5.85 wt %. Resin 15 formed a film layer after the aging curing reaction, and film wettability was 50-150%, and a water contact angle was less than 60 degrees (water droplet contact angle changed gradually from large to small), which was generally hydrophilic.

Example 16-Resin 16

Resin 16 was a solvent-free polyurethane resin and polymerized in a melt state. After the polymerization reaction was completed, the polyurethane hard segments were 32.80 wt %, and before the curing reaction, the isocyanate groups were 5.98 wt %. Resin 16 formed a film layer after the aging curing reaction, and film wettability was 50-150%, and a water contact angle was less than 60 degrees (water droplet contact angle changed gradually from large to small), which was generally hydrophilic.

Example 17-Resin 17

Resin 17 was a solvent-free polyurethane resin and polymerized in a melt state. After the polymerization reaction was completed, the polyurethane hard segments were 39.59 wt %, and all of the isocyanate groups had been reacted and could not be detected (equivalent to 0 wt %). Resin 17 formed a film layer after the drying curing reaction, and film wettability was 50-150%, and a water contact angle was less than 60 degrees (water droplet contact angle changed gradually from large to small), which was generally hydrophilic.

Example 18-Resin 18

Resin 18 was a solvent-free polyurethane resin and polymerized in a melt state. After the polymerization reaction was completed, the polyurethane hard segments were 11.18 wt %, and all of the isocyanate groups had been reacted and could not be detected (equivalent to 0 wt %). Resin 18 formed a film layer after the drying curing reaction, and film wettability was 50-150%, and a water contact angle was less than 60 degrees (water droplet contact angle changed gradually from large to small), which was generally hydrophilic.

Comparative Example 1-Resin 19

Resin 19 was a solvent-free polyurethane resin and polymerized in a melt state. After the polymerization reaction was completed, the polyurethane hard segments were 50.44 wt %, and before the curing reaction, the isocyanate groups were 7.63 wt %. Resin 19 formed a film layer after the aging curing reaction, and film wettability was less than 50%, and a water contact angle was greater than 60 degrees (water droplet contact angle remained unchanged, and it was obvious that Resin 19 was not hydrophilic). The proportion of the polyurethane hard segments in Resin 19 was high, and the content of the isocyanate groups were high, resulting in the surface layer being too rigid after curing, and hydrophilicity was poor, and the color rendering effect was poor.

Comparative Example 2-Resin 20

Resin 20 was a solvent-free polyurethane and polymerized in a melt state. After the polymerization reaction was completed, the polyurethane hard segments were 8.16 wt %, and before the curing reaction, the isocyanate groups were 2.57 wt %. Resin 20 formed a film layer after the aging curing reaction, and film wettability was less than 50%, and a water contact angle was greater than 60 degrees (water droplet contact angle remained unchanged, and it was obvious that Resin 20 was not hydrophilic). The proportion of the polyurethane hard segments in Resin 20 was low, resulting in the inability of the surface layer to cure well, and hydrophilicity was poor, and the color rendering effect was poor.

Comparative Example 3-Resin 21

Resin 21 was a solvent-based polyurethane and reacted and polymerized in a solvent state. After the polymerization reaction was completed, the polyurethane hard segments were 42.75 wt %, and all of the isocyanate groups had been reacted and could not be detected (equivalent to 0 wt %). Resin 21 formed a film layer after the drying curing reaction, and film wettability was less than 50%, and a water contact angle was greater than 60 degrees (water droplet contact angle remained unchanged, and it was obvious that Resin 21 was not hydrophilic). The proportion of the polyurethane hard segments in Resin 21 was high, resulting in the surface layer being too rigid after curing, and hydrophilicity was poor, and the color rendering effect was poor.

Comparative Example 4-Resin 22

Resin 22 was a solvent-based polyurethane and reacted and polymerized in a solvent state. After the polymerization reaction was completed, the polyurethane hard segments were 8.14 wt %, and all of the isocyanate groups had been reacted and could not be detected (equivalent to 0 wt %). Resin 22 formed a film layer after the drying curing reaction, and film wettability was less than 50%, and a water contact angle was greater than 60 degrees (water droplet contact angle remained unchanged, and it was obvious that Resin 22 was not hydrophilic). The proportion of the polyurethane hard segments in Resin 22 was low, resulting in the inability of the surface layer to cure well, and hydrophilicity was poor, and the color rendering effect was poor.

Comparative Example 5-Resin 23

Resin 23 was a water-based polyurethane and dispersed in an aqueous solution after the polymerization. After the polymerization reaction was completed, the polyurethane hard segments were 30.36 wt %, and all of the isocyanate groups of Resin 23 had been reacted and could not be detected (equivalent to 0 wt %). Resin 23 formed a film layer after the drying curing reaction, and film wettability was less than 50%, and a water contact angle was greater than 60 degrees (water droplet contact angle remained unchanged, and it was obvious that Resin 23 was not hydrophilic). Resin 23 had poor hydrophilicity and poor color rendering effect.

Comparative Example 6-Resin 24

Resin 24 was a solvent-free polyurethane resin and polymerized in a melt state. After the polymerization reaction was completed, the polyurethane hard segments were 4.45 wt %, and before the curing reaction, the isocyanate groups were 1.22 wt %. Film wettability of Resin 24 was 150-250%, and a water contact angle was less than 30 degrees. However, after the aging reaction, it could not be cured to form a film layer. It was speculated that the reason is that the proportion of the polyurethane hard segments were low, resulting in the inability of the surface layer to cure well. The water contact angle was less than 30 degrees, which was hydrophilic. It had color rendering effect before washing, but the color rendering effect after washing is poor due to poor film-forming property of the resin.

Comparative Example 7-Resin 25

Resin 25 was a solvent-free polyurethane and polymerized in a melt state. After the polymerization reaction was completed, the polyurethane hard segments were 8.05 wt %, and before the curing reaction, the isocyanate groups were 1.13 wt %. Film wettability of Resin 25 was 150-250%, and a water contact angle was less than 30 degrees. However, after the aging reaction, it could not be cured to form a film layer. It was speculated that the reason is that the proportion of the polyurethane hard segments were low, resulting in the inability of the surface layer to cure well. The water contact angle was less than 30 degrees, which was hydrophilic. It had color rendering effect before washing, but the color rendering effect after washing is poor due to poor film-forming property of the resin.

Related physical property test methods and specifications:

Test Method for Content of Isocyanate Groups of Measurement (—NCO)

Di-n-butylamine was dissolved in isopropanol and then reacted with the isocyanate groups of measurement of the resin sample, and titration was then performed on excess di-n-butylamine with a standard hydrochloric acid solution to calculate an amount of the isocyanate groups of measurement.

Measurement of Film Wettability

Referring to ISO 175, a sample with an area of 60 mm*60 mm and a thickness of about 0.05-0.1 mm was taken and placed in water at 23±° C. and soaked for about 2 hr. After the sample was taken out, water on a surface of the sample was wiped off. The water wettability of the sample was calculated by measuring weights of the sample before and after immersion and calculating the difference in weight. The sample needed to undergo the aging and curing reaction to form a film before testing.

Measurement of Water Contact Angle

A water contact angle measuring instrument (brand: Kruss; model: FM40) was used, and a resin was coated on a cloth substrate and then dried to form a film layer on the cloth substrate, and a water droplet was dropped on a surface of the film layer and measured with the above-mentioned water contact angle measuring instrument to obtain the water contact angle.

Test Method for Color Rendering Angle in Horizontal Field of View

The fabric was placed upright at a distance of 1 meter in front of an observer. The position of the fabric was basically on a same horizontal plane as the human eye, and the fabric was fixed. The observer's front viewing angle was moved horizontally to the left and right, and there was a maximum range that color alternating of the fabric can be observed, and it was the range of the visual angle of the horizontal color rendering.

Test Method for Color Rendering Angle in Vertical Field of View

The fabric was placed upright at a distance of 1 meter in front of an observer, and the fabric was fixed. The observer's front viewing angle was moved vertically to the up and down, and there was a maximum range that color alternating of the fabric can be observed, and it was the range of the visual angle of the vertical color rendering.

Water Washing Resistance Test

A washing machine conforming to AATCC-LP1 specification was used, and washing/drying repeated tests was carried out with reference to AATCC-135 method.

Chlorine Resistance Test

It was statically immersed in a sodium hypochlorite (NaClO) aqueous solution with a temperature of 25° C., pH of 6-7, and a chlorine concentration of 100 ppm for 168 hours.

Definition and Test Method for Color Rendering Variable Area

A ratio of color rendering variable area was defined as a ratio of the area of color alternating before and after water infiltration (moisture absorption) of the fabric. A0 is an area of the base portion hidden under the pleat portion before infiltration. A1 is an exposure area of the base portion after infiltration which originally being under the pleat portion. The ratio of color rendering variable area is (A0-A1)/A0×100%.

Experimental Example 1

In Experimental Example 1, Resins 1 to 25 of Examples 1 to 18 and Comparative Examples 1 to 7 were printed on an exterior outer facing side of a pleat portion in continuous hexagonal patterns, and color rendering angles thereof are shown in Table 2. The formulations of Examples 6-12 and 17 and Comparative Examples 6 and 7 were selected for the water washing test and the chlorine resistance test verification (statically immersed in the sodium hypochlorite aqueous solution with the chlorine concentration of 100 ppm) before and after, and the color rendering variable areas were measured, and results thereof are shown in Table 3. It could be known from Table 2 that when the water contact angle of the hydrophilic resin layer could not be less than 60 degrees, as shown in Comparative Examples 1 to 5, better color rendering angles (including horizontal and vertical viewing angles) could not be achieved. It could be known from Table 3 that when the hydrophilic resin layer could not meet the resin composition condition including 11 to 40 wt % of the polyurethane hard segments and not more than 6 wt % (including 0 to 6 wt %) of the isocyanate groups before the curing reaction, as shown in Comparative Examples 6 to 7, the resin could not form a film successfully and did not have good film-forming property, and the prepared fabrics were difficult to pass the water washing test. Therefore, according to the comprehensive judgment of the experimental results in Tables 2 and 3, when the water contact angle of the hydrophilic resin layer could not be less than 60 degrees, and the hydrophilic resin layer could not meet the resin composition condition including 11 to 40 wt % of the polyurethane hard segments and not more than 6 wt % (including 0 to 6 wt %) of the isocyanate groups before the curing reaction, the prepared fabrics could not have good color rendering effect and were difficult to pass the water washing test, and thus failed to be used in practice.

TABLE 2

| Verification of Color Rendering Effect | | | | | | | |
|---|---|---|---|---|---|---|---|
| | Hydrophilic layer resin | Weight percentage of polyurethane hard segments (%) | Weight percentage of isocyanate groups before curing reaction (%) | Water contact angle | Wettability of film layer after aging curing reaction | Maximum range of visual angle of color rendering: Horizontal field of view | Maximum range of visual angle of color rendering: Vertical field of view |
| Example 1 | Solvent-free polyurethane | 12.11 | 3.63 | <10° | 250-400% | 170° | 170° |
| Example 2 | | 11.02 | 2.72 | <10° | 250-400% | 170° | 170° |
| Example 3 | | 15.24 | 3.81 | <10° | 250-400% | 170° | 170° |
| Example 4 | | 12.21 | 4.21 | <10° | 250-400% | 170° | 170° |
| Example 5 | | 19.95 | 3.03 | <10° | 250-400% | 170° | 170° |
| Example 6 | | 11.94 | 5.09 | <10° | 250-400% | 170° | 170° |
| Example 7 | | 21.95 | 5.51 | <30° | 150-250% | 170° | 150° |
| Example 8 | | 20.40 | 3.18 | <30° | 150-250% | 170° | 150° |
| Example 9 | | 20.40 | 3.26 | <30° | 150-250% | 170° | 150° |
| Example 10 | | 20.50 | 3.52 | <30° | 150-250% | 170° | 150° |
| Example 11 | | 18.30 | 3.04 | <30° | 150-250% | 170° | 150° |
| Example 12 | | 18.78 | 4.50 | <30° | 150-250% | 170° | 150° |
| Example 13 | | 21.91 | 5.40 | <60° | 50-150% | 170° | 120° |
| Example 14 | | 24.91 | 2.74 | <60° | 50-150% | 170° | 120° |
| Example 15 | | 24.97 | 5.85 | <60° | 50-150% | 170° | 120° |
| Example 16 | | 32.80 | 5.98 | <60° | 50-150% | 170° | 120° |
| Example 17 | | 39.59 | 0 | <60° | 50-150% | 170° | 120° |
| Example 18 | | 11.18 | 0 | <60° | 50-150% | 170° | 120° |
| Comparative Example 1 | Solvent-free polyurethane | 50.44 | 7.63 | >60° | <50% | Failed to render color | |
| Comparative Example 2 | | 8.16 | 2.57 | >60° | <50% | Failed to render color | |
| Comparative Example 3 | Solvent-based polyurethane | 42.75 | 0 | >60° | <50% | Failed to render color | |
| Comparative Example 4 | | 8.14 | 0 | >60° | <50% | Failed to render color | |
| Comparative Example 5 | Water-based polyurethane | 30.36 | 0 | >60° | <50% | Failed to render color | |
| Comparative Example 6 | Solvent-free polyurethane | 4.45 | 1.22 | <30° | 150-250% | could render color before washing, but failed to render color after washing | |
| Comparative Example 7 | | 8.05 | 1.13 | | 150-250% | | |

TABLE 3

| Verification of Color Rendering Variable Area of Water Washing Test and Chlorine Resistance Test | | | | | | |
|---|---|---|---|---|---|---|
| | | | Color rendering variable area % | | | |
| | | | Water washing resistance test | | Chlorine resistance test | |
| | Weight percentage of polyurethane hard segments (%) | Weight percentage of isocyanate groups before curing reaction (%) | Unwashed | Washed for 20 cycle times | 0 hr | Statically immersed in sodium hypochlorite aqueous solution (chlorine concentration of 100 ppm) for 168 hours |
| Example 6 | 11.94 | 5.09 | 27.5%-37.5% | 27.5%-37.5% | 27.5%-37.5% | 27.5%-37.5% |
| Example 7 | 21.95 | 5.51 | 27.5%-37.5% | 27.5%-37.5% | 27.5%-37.5% | 27.5%-37.5% |
| Example 8 | 20.40 | 3.18 | 27.5%-37.5% | 27.5%-37.5% | 27.5%-37.5% | 27.5%-37.5% |
| Example 9 | 20.40 | 3.26 | 27.5%-37.5% | 27.5%-37.5% | 27.5%-37.5% | 27.5%-37.5% |
| Example 10 | 20.50 | 3.52 | 27.5%-37.5% | 27.5%-37.5% | 27.5%-37.5% | 27.5%-37.5% |
| Example 11 | 18.30 | 3.04 | 27.5%-37.5% | 27.5%-37.5% | 27.5%-37.5% | 27.5%-37.5% |
| Example 12 | 18.78 | 4.50 | 27.5%-37.5% | 27.5%-37.5% | 27.5%-37.5% | 27.5%-37.5% |
| Example 17 | 39.59 | 0 | 27.5%-37.5% | 27.5%-37.5% | 27.5%-37.5% | 27.5%-37.5% |
| Comparative Example 6 | 4.45 | 1.22 | 27.5%-37.5% | Failed to render color | 27.5%-37.5% | Failed to render color |
| Comparative Example 7 | 8.05 | 1.13 | 27.5%-37.5% | Failed to render color | 27.5%-37.5% | Failed to render color |

Experimental Example 2

In Experimental Example 2, Resins 1 to 25 of Examples 1 to 18 and Comparative Examples 1 to 7 were printed on an exterior outer facing side of a pleat portion in discontinuous dots, and color rendering angles thereof are shown in Table 4, and when the water contact angle of the hydrophilic resin layer could not be less than 60 degrees, better color rendering angles (including horizontal and vertical viewing angles) could not be achieved. The formulations of Examples 6-12 and 17 and Comparative Examples 6 and 7 were selected for the water washing test and the chlorine resistance test verification (statically immersed in the sodium hypochlorite aqueous solution with the chlorine concentration of 100 ppm) before and after, and the color rendering variable areas were measured, and results thereof are shown in Table 5, and when the hydrophilic resin layer could not meet the resin composition condition including 11 to 40 wt % of the polyurethane hard segments and not more than 6 wt % (including 0 to 6 wt %) of the isocyanate groups before the curing reaction, as shown in Comparative Examples 6 to 7, the resin could not form a film successfully and did not have good film-forming property, and were difficult to pass the water washing test. Therefore, according to the judgment of the experimental results in Tables 4 and 5, when the water contact angle of the hydrophilic resin layer could not be less than 60 degrees, and the hydrophilic resin layer could not meet the resin composition condition including 11 to 40 wt % of the polyurethane hard segments and not more than 6 wt % (including 0 to 6 wt %) of the isocyanate groups before the curing reaction, the prepared fabrics could not have good color rendering effect and were difficult to pass the water washing test, and thus failed to be used in practice.

TABLE 4

Verification of Color Rendering Effect

| | Hydrophilic layer resin | Weight percentage of polyurethane hard segments (%) | Weight percentage of isocyanate groups before curing reaction (%) | Water contact angle | Maximum range of visual angle of color rendering | |
|---|---|---|---|---|---|---|
| | | | | | Horizontal field of view | Vertical field of view |
| Example 1 | Solvent-free polyurethane | 12.11 | 3.63 | <10° | 170° | 170° |
| Example 2 | | 11.02 | 2.72 | <10° | 170° | 170° |
| Example 3 | | 15.24 | 3.81 | <10° | 170° | 170° |
| Example 4 | | 12.21 | 4.21 | <10° | 170° | 170° |
| Example 5 | | 19.95 | 3.03 | <10° | 170° | 170° |
| Example 6 | | 11.94 | 5.09 | <10° | 170° | 170° |
| Example 7 | | 21.95 | 5.51 | <30° | 170° | 150° |
| Example 8 | | 20.40 | 3.18 | <30° | 170° | 150° |
| Example 9 | | 20.40 | 3.26 | <30° | 170° | 150° |
| Example 10 | | 20.50 | 3.52 | <30° | 170° | 150° |
| Example 11 | | 18.30 | 3.04 | <30° | 170° | 150° |
| Example 12 | | 18.78 | 4.50 | <30° | 170° | 150° |
| Example 13 | | 21.91 | 5.40 | <60° | 170° | 120° |
| Example 14 | | 24.91 | 2.74 | <60° | 170° | 120° |
| Example 15 | | 24.97 | 5.85 | <60° | 170° | 120° |
| Example 16 | | 32.80 | 5.98 | <60° | 170° | 120° |
| Example 17 | | 39.59 | 0 | <60° | 170° | 120° |
| Example 18 | | 11.18 | 0 | <60° | 170° | 120° |
| Comparative Example 1 | Solvent-free polyurethane | 50.44 | 7.63 | >60° | Failed to render color | |
| Comparative Example 2 | | 8.16 | 2.57 | >60° | Failed to render color | |
| Comparative Example 3 | Solvent-based polyurethane | 42.75 | 0 | >60° | Failed to render color | |
| Comparative Example 4 | | 8.14 | 0 | >60° | Failed to render color | |
| Comparative Example 5 | Water-based polyurethane | 30.36 | 0 | >60° | Failed to render color | |
| Comparative Example 6 | Solvent-free polyurethane | 4.45 | 1.22 | <30° | could render color before washing, but failed to render color after washing | |
| Comparative Example 7 | | 8.05 | 1.13 | | | |

TABLE 5

Verification of Color Rendering Variable Area of Water Washing Test and Chlorine Resistance Test percentage of

| | Weight percentage of polyurethane hard segments (%) | Weight percentage of isocyanate groups before curing reaction (%) | Color rendering variable area % | | | |
|---|---|---|---|---|---|---|
| | | | Water washing resistance test | | Chlorine resistance test | |
| | | | Unwashed | Washed for 20 cycle times | 0 hr | Statically immersed in sodium hypochlorite aqueous solution (chlorine concentration of 100 ppm) for 168 hours |
| Example 6 | 11.94 | 5.09 | 27.5%-37.5% | 27.5%-37.5% | 27.5%-37.5% | 27.5%-37.5% |
| Example 7 | 21.95 | 5.51 | 27.5%-37.5% | 27.5%-37.5% | 27.5%-37.5% | 27.5%-37.5% |
| Example 8 | 20.40 | 3.18 | 27.5%-37.5% | 27.5%-37.5% | 27.5%-37.5% | 27.5%-37.5% |
| Example 9 | 20.40 | 3.26 | 27.5%-37.5% | 27.5%-37.5% | 27.5%-37.5% | 27.5%-37.5% |
| Example 10 | 20.50 | 3.52 | 27.5%-37.5% | 27.5%-37.5% | 27.5%-37.5% | 27.5%-37.5% |
| Example 11 | 18.30 | 3.04 | 27.5%-37.5% | 27.5%-37.5% | 27.5%-37.5% | 27.5%-37.5% |
| Example 12 | 18.78 | 4.50 | 27.5%-37.5% | 27.5%-37.5% | 27.5%-37.5% | 27.5%-37.5% |
| Example 17 | 39.59 | 0 | 27.5%-37.5% | 27.5%-37.5% | 27.5%-37.5% | 27.5%-37.5% |
| Comparative Example 6 | 4.45 | 1.22 | 27.5%-37.5% | Failed to render color | 27.5%-37.5% | Failed to render color |
| Comparative Example 7 | 8.05 | 1.13 | 27.5%-37.5% | Failed to render color | 27.5%-37.5% | Failed to render color |

Experimental Example 3

In Experimental Example 3, Resins 1 to 25 of Examples 1 to 18 and Comparative Examples 1 to 7 were printed on one side of a base portion of the fabric in a discontinuous linear pattern. A printed area of the hydrophilic layer accounted for about 40% of a total area of the base layer of the fabric. The color rendering angles are shown in Table 6. When the water contact angle of the hydrophilic layer resin could not be less than 60 degrees, it could not be used, better color rendering angles (including horizontal and vertical viewing angles) could not be achieved. The formulations of Examples 7-12 and Comparative Examples 6 and 7 were selected for the water washing test and the chlorine resistance test (statically immersed in the sodium hypochlorite aqueous solution with the chlorine concentration of 100 ppm) before and after, and the color rendering variable areas were measured, and results thereof are shown in Table 7. It could be known from Tables 6 and 7 that when the water contact angle of the hydrophilic resin layer could not be less than 60 degrees, and the hydrophilic resin layer could not meet the resin composition condition including 11 to 40 wt % of the polyurethane hard segments and not more than 6 wt % (including 0 to 6 wt %) of the isocyanate groups before the curing reaction, as shown in Comparative Examples 6 to 7, the resins were difficult to pass the water washing test, and thus failed to be used in practice.

TABLE 6

Verification of Color Rendering Effect

| | Hydrophilic layer resin | Weight percentage of polyurethane hard segments (%) | Weight percentage of isocyanate groups before curing reaction (%) | Water contact angle | Maximum range of visual angle of color rendering | |
|---|---|---|---|---|---|---|
| | | | | | Horizontal field of view | Vertical field of view |
| Example 1 | Solvent-free polyurethane | 12.11 | 3.63 | <10° | 170° | 170° |
| Example 2 | | 11.02 | 2.72 | <10° | 170° | 170° |
| Example 3 | | 15.24 | 3.81 | <10° | 170° | 170° |
| Example 4 | | 12.21 | 4.21 | <10° | 170° | 170° |
| Example 5 | | 19.95 | 3.03 | <10° | 170° | 170° |
| Example 6 | | 11.94 | 5.09 | <10° | 170° | 170° |
| Example 7 | | 21.95 | 5.51 | <30° | 170° | 150° |
| Example 8 | | 20.40 | 3.18 | <30° | 170° | 150° |
| Example 9 | | 20.40 | 3.26 | <30° | 170° | 150° |
| Example 10 | | 20.50 | 3.52 | <30° | 170° | 150° |
| Example 11 | | 18.30 | 3.04 | <30° | 170° | 150° |
| Example 12 | | 18.78 | 4.50 | <30° | 170° | 150° |
| Example 13 | | 21.91 | 5.40 | <60° | 170° | 120° |
| Example 14 | | 24.91 | 2.74 | <60° | 170° | 120° |
| Example 15 | | 24.97 | 5.85 | <60° | 170° | 120° |
| Example 16 | | 32.80 | 5.98 | <60° | 170° | 120° |
| Example 17 | | 39.59 | 0 | <60° | 170° | 120° |
| Example 18 | | 11.18 | 0 | <60° | 170° | 120° |

TABLE 6-continued

| Verification of Color Rendering Effect | | | | | | |
|---|---|---|---|---|---|---|
| | | | | | Maximum range of visual angle of color rendering | |
| | Hydrophilic layer resin | Weight percentage of polyurethane hard segments (%) | Weight percentage of isocyanate groups before curing reaction (%) | Water contact angle | Horizontal field of view | Vertical field of view |
| Comparative Example 1 | Solvent-free polyurethane | 50.44 | 7.63 | >60° | Failed to render color | |
| Comparative Example 2 | | 8.16 | 2.57 | >60° | Failed to render color | |
| Comparative Example 3 | Solvent-based polyurethane | 42.75 | 0 | >60° | Failed to render color | |
| Comparative Example 4 | | 8.14 | 0 | >60° | Failed to render color | |
| Comparative Example 5 | Water-based polyurethane | 30.36 | 0 | >60° | Failed to render color | |
| Comparative Example 6 | Solvent-free polyurethane | 4.45 | 1.22 | <30° | could render color before washing, but failed to render color after washing | |
| Comparative Example 7 | | 8.05 | 1.13 | | | |

TABLE 7

| Verification of Color Rendering Variable Area of Water Washing Test and Chlorine Resistance Test | | | | | | |
|---|---|---|---|---|---|---|
| | | | Color rendering variable area % | | | |
| | | | | | Chlorine resistance test | |
| | Weight percentage of polyurethane hard segments (%) | Weight percentage of isocyanate groups before curing reaction (%) | Water washing resistance test | | | Statically immersed in sodium hypochlorite aqueous solution (chlorine concentration of 100 ppm) for 168 hours |
| | | | Unwashed | Washed for 20 cycle times | 0 hr | |
| Example 7 | 21.95 | 5.51 | 40% | 40% | 40% | 40% |
| Example 8 | 20.40 | 3.18 | 40% | 40% | 40% | 40% |
| Example 9 | 20.40 | 3.26 | 40% | 40% | 40% | 40% |
| Example 10 | 20.50 | 3.52 | 40% | 40% | 40% | 40% |
| Example 11 | 18.30 | 3.04 | 40% | 40% | 40% | 40% |
| Example 12 | 18.78 | 4.50 | 40% | 40% | 40% | 40% |
| Comparative Example 6 | 4.45 | 1.22 | 40% | Failed to render color | 40% | Failed to render color |
| Comparative Example 7 | 8.05 | 1.13 | 40% | Failed to render color | 40% | Failed to render color |

Figure 9A:
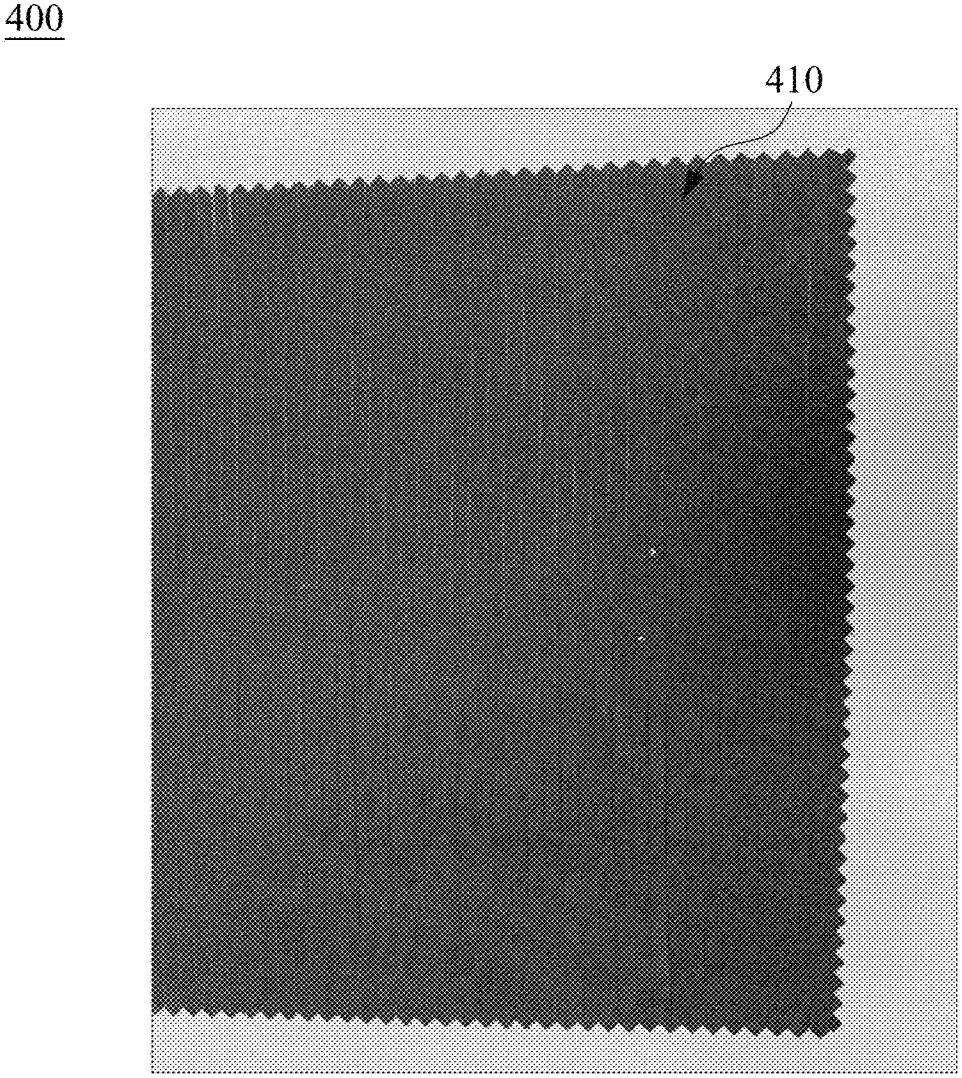
FIG. 9A is a top view photo of an alternating color fabric of an embodiment of the present disclosure before absorbing moisture.
Figure 9B:
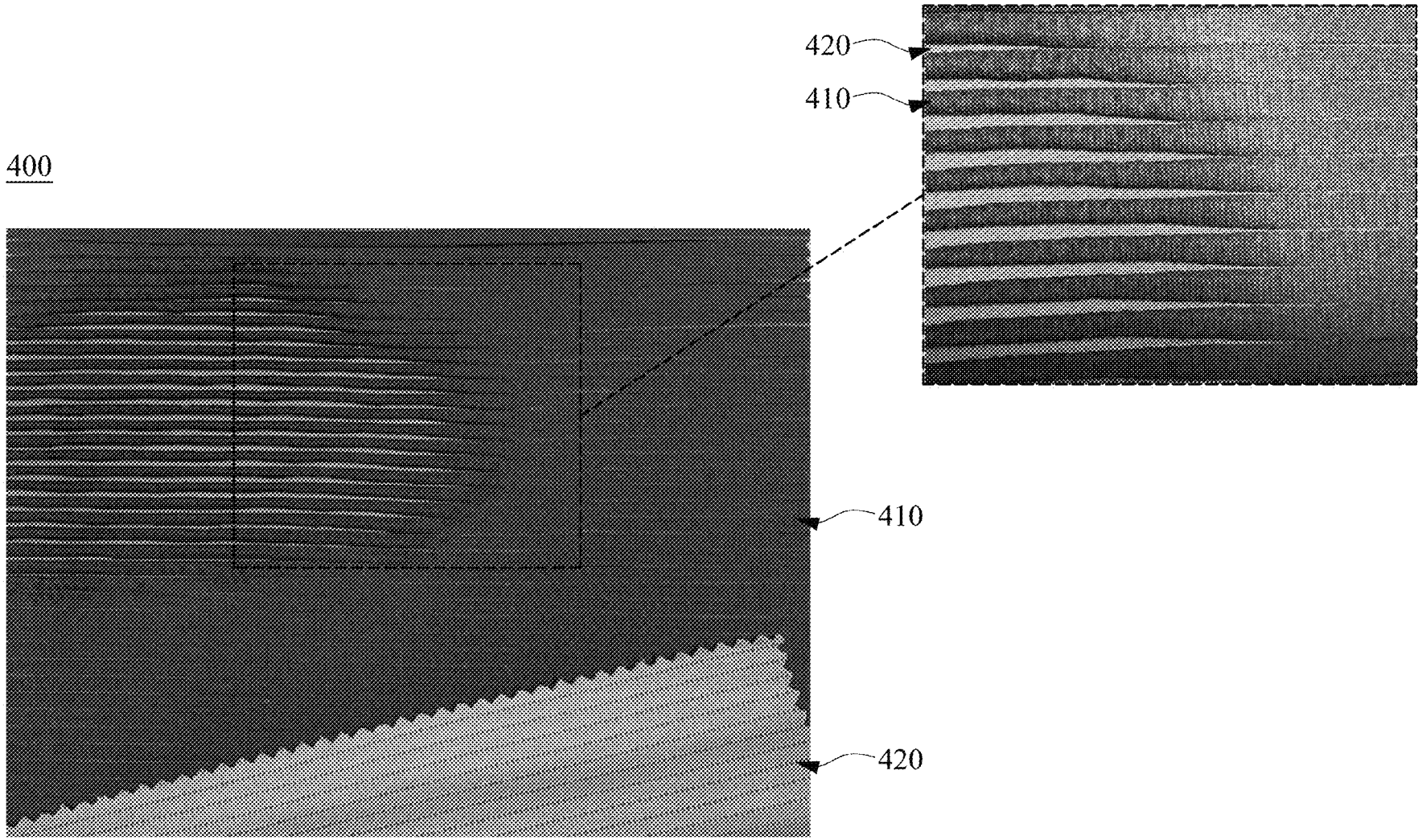
FIG. 9B is a top view photo of an alternating color fabric of an embodiment of the present disclosure after absorbing moisture.
Figure 10A:
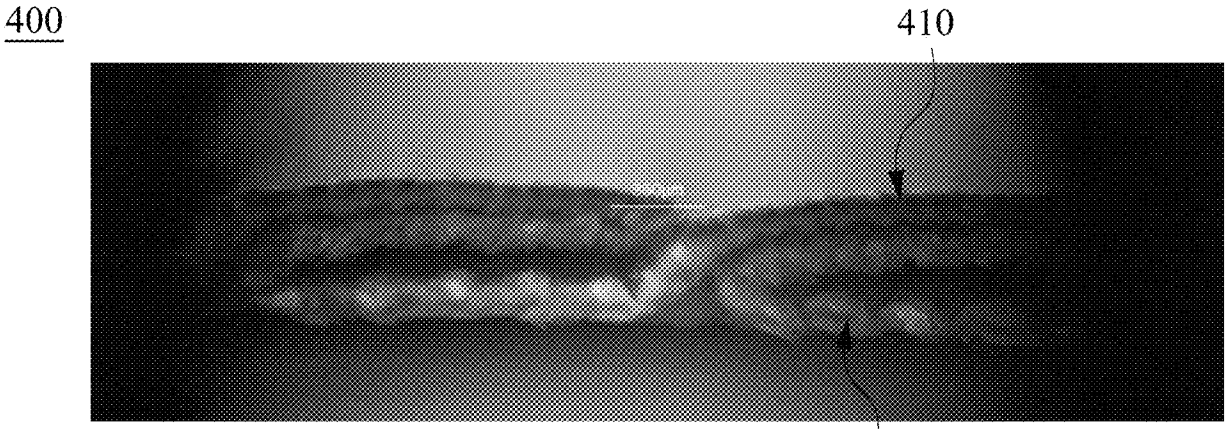
FIG. 10A is a side view photo of an alternating color fabric of an embodiment of the present disclosure before absorbing moisture.
Figure 10B:
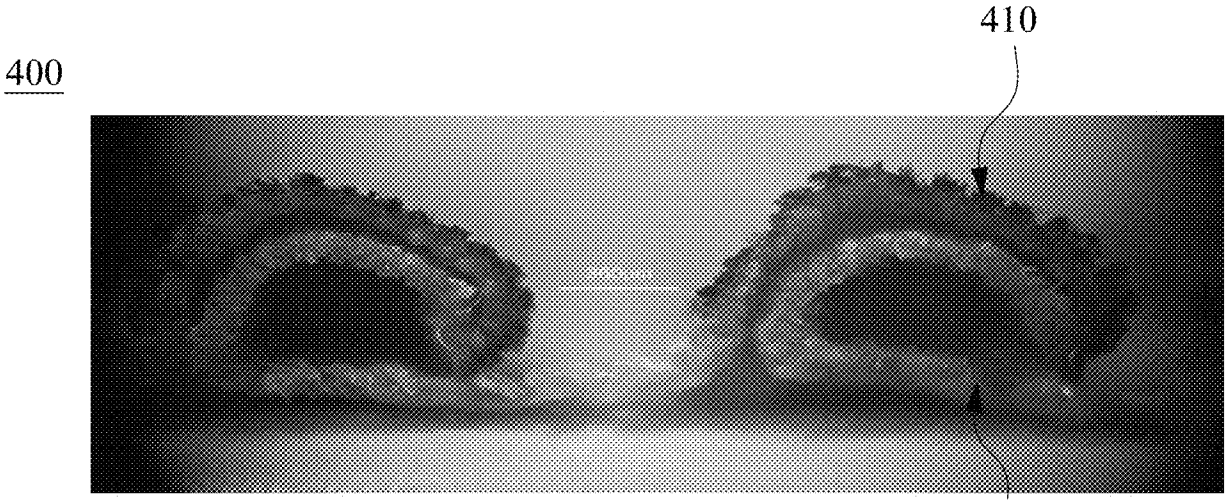
FIG. 10B is a side view photo of an alternating color fabric of an embodiment of the present disclosure after absorbing moisture.
Figures 10C, 10D, 10E:
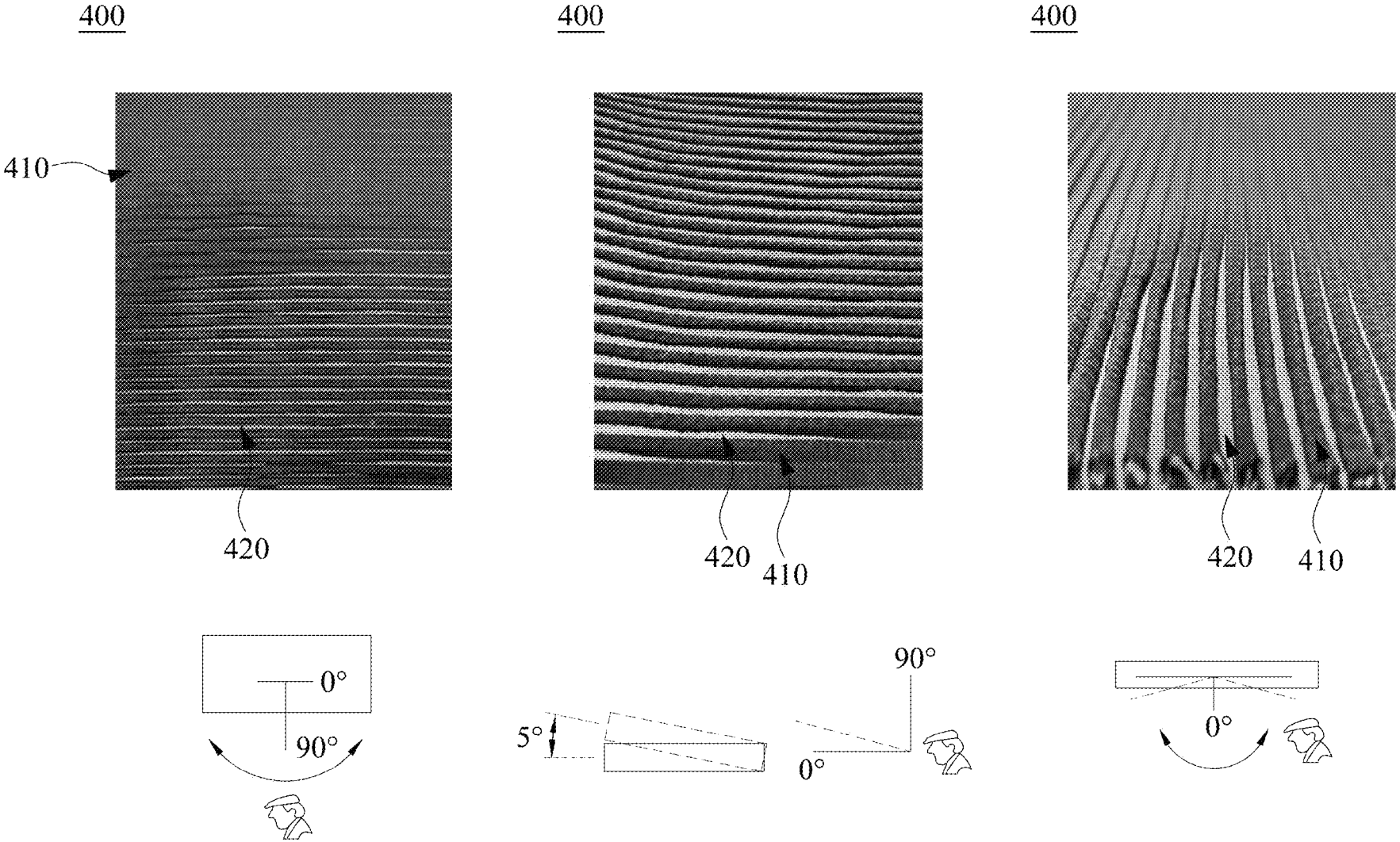
FIG. 10C is a top view photo of an alternating color fabric of an embodiment of the present disclosure when the fabric is laid flat.
FIG. 10D is a top view photo of an alternating color fabric of an embodiment of the present disclosure when the fabric is laid flat, in which the fabric is placed slightly obliquely.
FIG. 10E is a side view photo of an alternating color fabric of an embodiment of the present disclosure when the fabric is laid flat.

Finally, please refer to FIGS. 9A, 9B, 10A, 10B, 10C, 10D, and 10E. FIG. 9A is a top view photo of an alternating color fabric of an embodiment of the present disclosure before absorbing moisture. FIG. 9B is a side view photo of an alternating color fabric of an embodiment of the present disclosure after absorbing moisture. FIG. 10A is a side view photo of an alternating color fabric of an embodiment of the present disclosure before absorbing moisture. FIG. 10B is a side view photo of an alternating color fabric of an embodiment of the present disclosure after absorbing moisture. FIG. 10C is a top view photo of an alternating color fabric of an embodiment of the present disclosure when the fabric is laid flat. FIG. 10D is a top view photo of an alternating color fabric of an embodiment of the present disclosure when the fabric is laid flat, in which the fabric is placed slightly obliquely. FIG. 10E is a side view photo of an alternating color fabric of an embodiment of the present disclosure when the fabric is laid flat.

In this embodiment, a pleat portion 410 and a base portion 420 of an alternating color fabric 400 are respectively woven by yarns having different colors. Specifically, the pleat portion 410 of a surface layer is woven by purple yarns, and the base portion 420 of a bottom layer is woven by blue yarns, and a hydrophilic resin layer printed on a surface of the pleat portion 410 may be transparent or has a similar or different color from the pleat portion 410. In this embodiment, a transparent hydrophilic resin layer is taken as an example for description.

From FIGS. 9A and 10A, it can be known that after the alternating color fabric 400 absorbs moisture, the purple pleat portion 410 curls to expose the blue base portion 420 there beneath. From FIGS. 9B and 10B, it can be confirmed that before the alternating color fabric 400 has absorbed moisture, the pleat portion 410 is substantially flat against the base portion 420, and after the alternating color fabric 400 absorbs moisture, the pleat portion 410 curls to expose the base portion 420.

From the photos of FIGS. 10C, 10D, and 10E, it can be known that after the alternating color fabric 400 absorbs moisture, whether from a top view angle when it is laid flat, from a top view angle when it is placed slightly obliquely, or from a side view angle when it is laid flat, the phenomenon that the bottom color is exposed and the visual changing effect of the alternating color fabric 400 can be clearly observed.

Figure 11B:
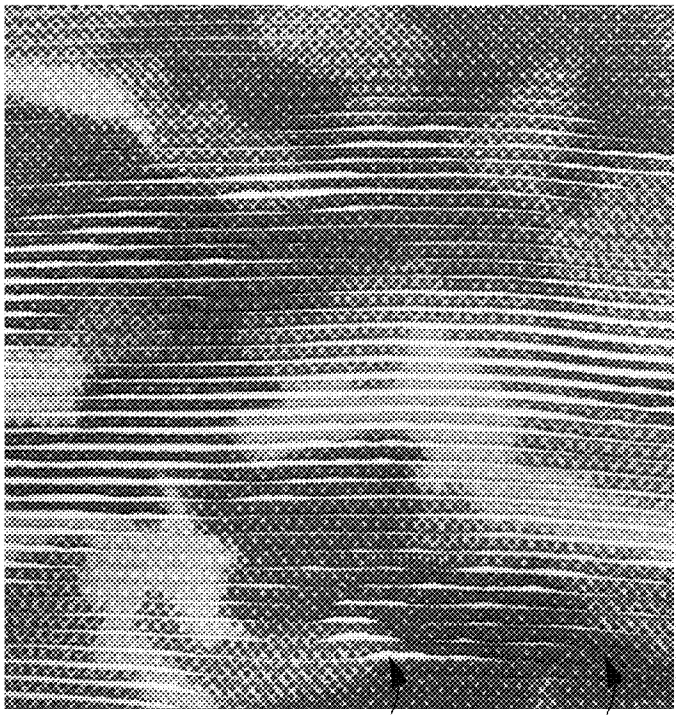
FIGS. 11B, 11C, and 11D are top view photos of an alternating color fabric of another embodiment of the present disclosure after absorbing moisture.
Figure 11A:
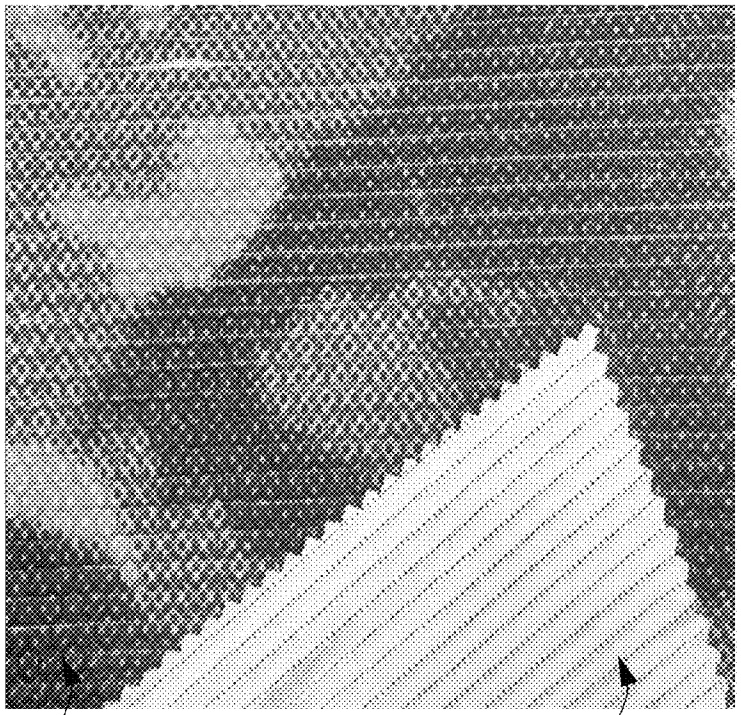
FIG. 11A is a top view photo of an alternating color fabric of another embodiment of the present disclosure before absorbing moisture.
Figure 11D:
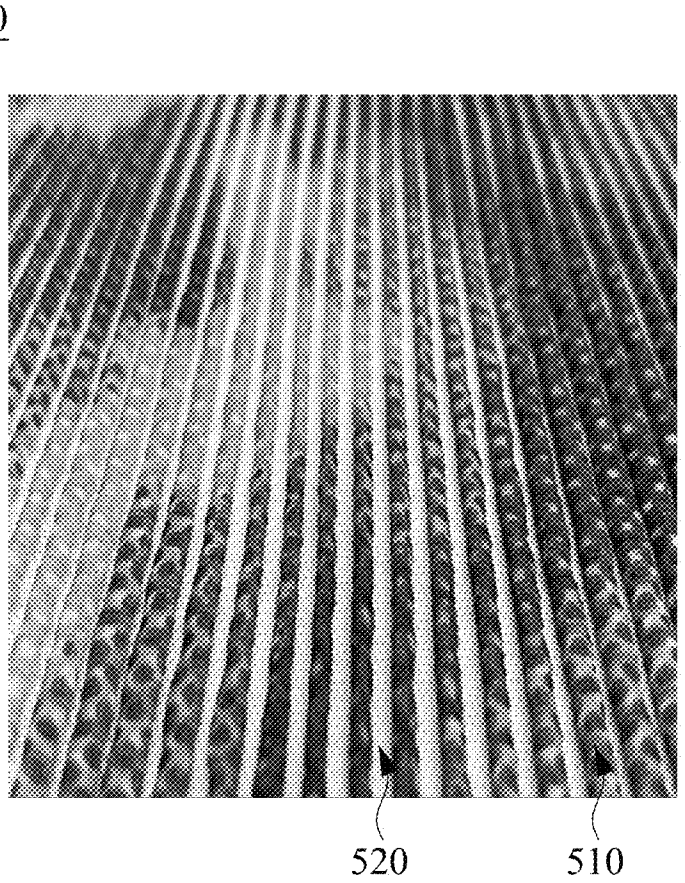
Figure 11C:
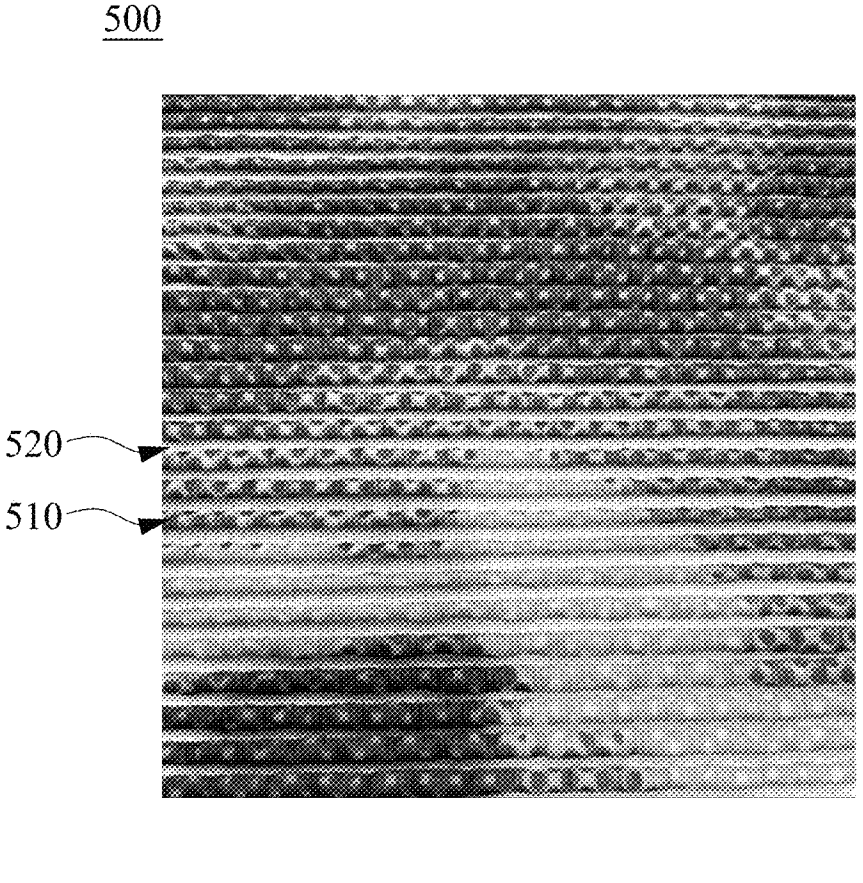

Next, referring to FIGS. 11A to 11D, FIG. 11A is a top view photo of an alternating color fabric of another embodiment of the present disclosure before absorbing moisture, and FIGS. 11B, 11C, and 11D are top view photos of an alternating color fabric of another embodiment of the present disclosure after absorbing moisture, in which the alternating color fabric is laid flat.

Figure 12B:
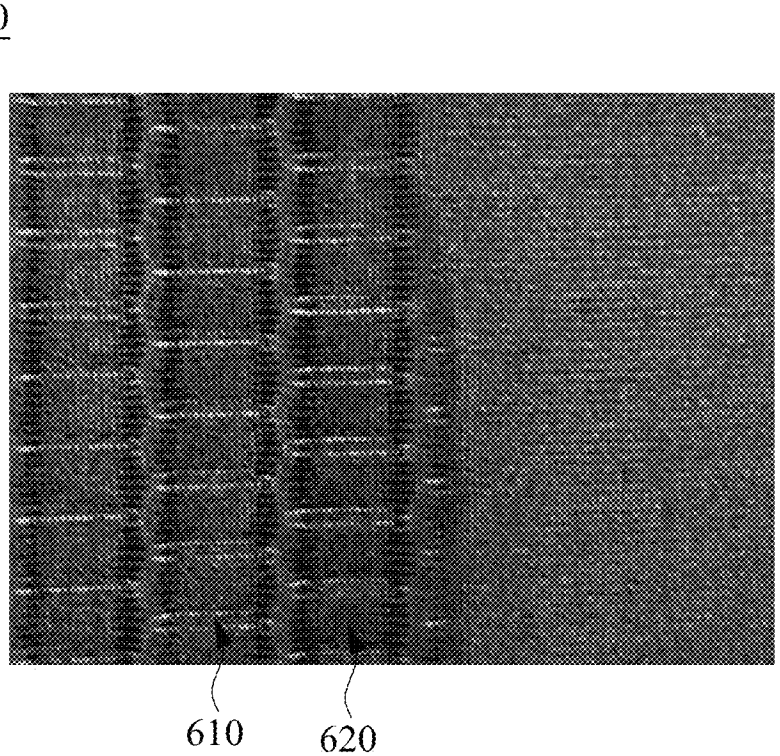
FIG. 12B is a top view photo of an alternating color fabric of another embodiment of the present disclosure after absorbing moisture.
Figure 12A:
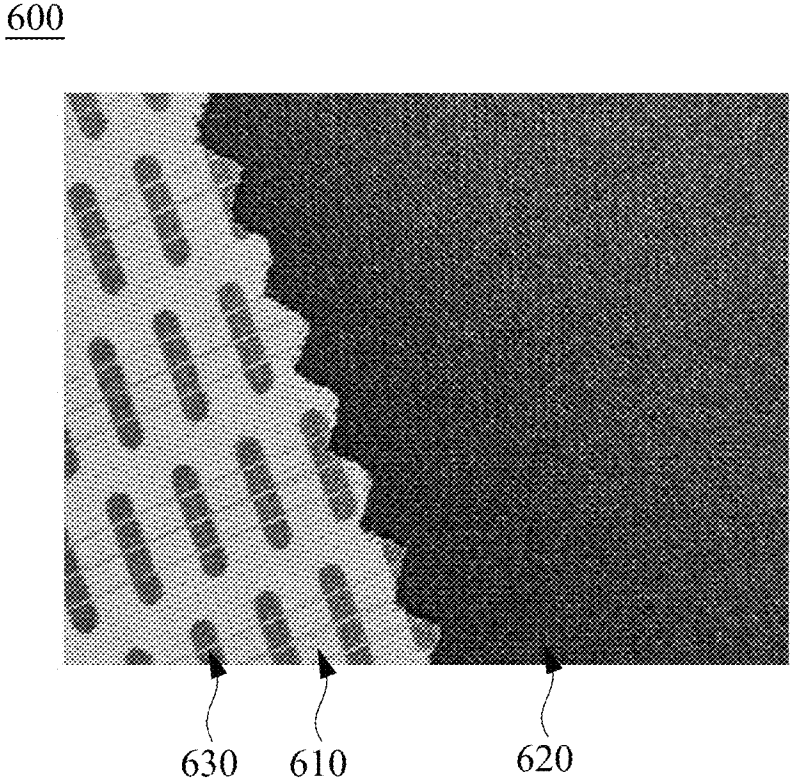
FIG. 12A is a top view photo of an alternating color fabric of another embodiment of the present disclosure before absorbing moisture.

In other embodiments, the aforementioned hydrophilic resin can also be applied to an alternating color fabric that only has a base portion, as shown in FIGS. 12A and 12B, in which FIG. 12A is a top view photo of an alternating color fabric of another embodiment of the present disclosure before absorbing moisture, and FIG. 12B is a top view photo of an alternating color fabric of another embodiment of the present disclosure after absorbing moisture, in which the alternating color fabric is laid flat.

Similarly, the hydrophilic resin layer 630 must include 11 wt % to 40 wt % of the polyurethane hard segments and the hydrophilic resin layer 630 includes not more than 6 wt % (including 0-6 wt %) of the isocyanate groups before the curing reaction, and the water contact angle of the hydrophilic resin layer 630 is less than 60 degrees to achieve the visual changing effect and pass the water washing resistance and chlorine resistance test specifications.

In summary, the present disclosure provides the alternating color fabric coated with the hydrophilic resin layer on the fabric, which can exhibit good visual changing effect at the color rendering angle in the vertical field of view or the color rendering angle in the horizontal field of view, and can pass the water washing resistance and chlorine resistance test specifications. Compared with the prior art, such as U.S. patent application Ser. No. 16/275,593 and Taiwan Patent Publication No. 202002829A, the present disclosure provides a completely different operation mechanism, and can solve the problems that the prior art is limited by the degree of flap warping, which makes the visual changing effect is insignificant and the visual angle of color rendering is limited. In addition, the alternating color fabric disclosed in the present disclosure can pass the water washing resistance and chlorine resistance test specifications, and thus is suitable for application in different textile fields.

An embodiment of the present disclosure provides an alternating color fabric, which includes a base portion woven by first yarns, a pleat portion woven by second yarns, and a hydrophilic resin layer disposed on the pleat portion. The base portion and the pleat portion are liftable connected by a connecting portion. The pleat portion at least partially covers the base portion. A water contact angle of the hydrophilic resin layer is not more than 60 degrees. The base portion presents a primary color, and the pleat portion presents a secondary color, and the primary color is different from the secondary color.

In some embodiments, the pleat portion includes an exterior outer facing side and an exterior inner facing side that are connected, the exterior inner facing side faces the base portion, and the hydrophilic resin layer is coated on the exterior outer facing side. In some embodiments, the pleat portion includes an exterior outer facing side and an exterior inner facing side that are connected, the exterior inner facing side faces the base portion, and the hydrophilic resin layer is coated on the exterior inner facing side. In some embodiments, the pleat portion includes an exterior outer facing side and an exterior inner facing side that are connected, the exterior inner facing side faces the base portion, and the hydrophilic resin layer is coated on both the exterior inner facing side and the exterior outer facing side. In some embodiments, the pleat portion completely covers the base portion. In some embodiments, the base portion is partially exposed from the pleat portion. In some embodiments, the alternating color fabric has a color rendering angle in a horizontal field of view up to 170 degrees. In some embodiments, the alternating color fabric has a color rendering angle in a vertical field of view up to 120 degrees. In some embodiments, a surface coverage ratio of the hydrophilic resin layer on the pleat portion is in a range of 10% to 99%. In some embodiments, resin of the hydrophilic resin layer comprises polyurethane resin, in which a content of hard segments of the polyurethane resin accounts for 11-40 wt % of a total composition. In some embodiments, resin of the hydrophilic resin layer comprises polyurethane resin having isocyanate groups, in which the isocyanate groups has a content not more than 6 wt % including 0-6 wt % before curing reaction. In some embodiments, the alternating color fabric has a color rendering variable area of 2% to 40% after water washed for 20 cycle times. In some embodiments, the alternating color fabric has a color rendering variable area of 2% to 40% following the AATCC 162-2002 Test Method.

Another embodiment of the present disclosure provides an alternating color fabric, which includes a base portion woven by first yarns, a pleat portion woven by second yarns, and a hydrophilic polymer layer disposed on the pleat portion. The pleat portion and the base portion are formed from hot pressing one greige fabric, and the pleat portion and the base portion are liftable and connected without any connecting portion. A water contact angle of the hydrophilic resin layer is not more than 60 degrees. The base portion presents a primary color, and the pleat portion presents a secondary color, and the primary color is different from the secondary color.

In some embodiments, the hydrophilic resin layer has a pattern that is formed continuously. In some embodiments, the hydrophilic resin layer has a plurality of solid type or hollow type discontinuous patterns, and the solid type or hollow type discontinuous patterns are dots, lines, stripes, squares, circles, ellipses, polygons, irregular patterns, or combinations thereof. In some embodiments, the hydrophilic resin layer presents a third color, and the third color is different from the primary color. In some embodiments, the hydrophilic resin layer presents a third color, and the third color is different from the secondary color. Another embodiment of the present disclosure provides an alternating color fabric, which includes a base portion and a hydrophilic resin layer disposed on one or both sides of the base portion. A water contact angle of the hydrophilic resin layer less than 60 degrees. The base portion is woven by at least one kind of yarns. When the base portion is woven by one kind of yarns, a printing coating layer is further formed on a surface of the hydrophilic resin layer or a surface of the base portion. When the base portion is woven by two or more kinds of yarns, the yarns have two or more colors. Color of the yarns of the base portion, color of the hydrophilic resin layer, and color of the printing coating layer are similar or different, and a coverage ratio of the hydrophilic resin layer on the base portion is in a range of 1% to 99%. In some embodiments, the printing coating layer formed on the surface of the hydrophilic resin layer partially covers an upper or lower side of the hydrophilic resin layer. In some embodiments, a color rendering pattern of the alternating color fabric is consistent with a coating pattern of the hydrophilic resin layer on the base portion.

Although the present disclosure has been disclosed in the above embodiments, it is not intended to limit the present disclosure. Anyone who is familiar with this technique can make various changes and modifications without departing from the spirit and scope of the present disclosure. Therefore, the scope of protection of the present disclosure shall be subject to the scope of appended claims.

What is claimed is:

1. An alternating color fabric, comprising:

a base portion woven by first yarns;

a pleat portion woven by second yarns, and the base portion and the pleat portion being liftable connected by a connecting portion, wherein the pleat portion at least partially covers the base portion; and a hydrophilic resin layer disposed on the pleat portion, wherein a water contact angle of the hydrophilic resin layer is not more than 60 degrees, wherein the base portion presents a primary color, and the pleat portion presents a secondary color, and the primary color is different from the secondary color, wherein the alternating color fabric has a color rendering variable area greater than 2% after water washed for 20 cycle times.

2. The alternating color fabric of claim 1, wherein the pleat portion comprises an exterior outer facing side and an exterior inner facing side that are connected, the exterior inner facing side faces the base portion, and the hydrophilic resin layer is coated on the exterior outer facing side.

3. The alternating color fabric of claim 1, wherein the pleat portion comprises an exterior outer facing side and an exterior inner facing side that are connected, the exterior inner facing side faces the base portion, and the hydrophilic resin layer is coated on the exterior inner facing side.

4. The alternating color fabric of claim 1, wherein the pleat portion comprises an exterior outer facing side and an exterior inner facing side that are connected, the exterior inner facing side faces the base portion, and the hydrophilic resin layer is coated on both the exterior inner facing side and the exterior outer facing side.

5. The alternating color fabric of claim 1, wherein the pleat portion completely covers the base portion.

6. The alternating color fabric of claim 1, wherein the base portion is partially exposed from the pleat portion.

7. The alternating color fabric of claim 1, wherein the alternating color fabric has a color rendering angle in a horizontal field of view up to 170 degrees.

8. The alternating color fabric of claim 1, wherein the alternating color fabric has a color rendering angle in a vertical field of view up to 120 degrees.

9. The alternating color fabric of claim 1, wherein a surface coverage ratio of the hydrophilic resin layer on the pleat portion is in a range of 10% to 99%.

10. The alternating color fabric of claim 1, wherein resin of the hydrophilic resin layer comprises polyurethane resin, wherein a content of hard segments of the polyurethane resin accounts for 11-40 wt % of a total composition.

11. The alternating color fabric of claim 1, wherein resin of the hydrophilic resin layer comprises polyurethane resin having isocyanate groups, wherein the isocyanate groups has a content not more than 6 wt % including 0-6 wt % before curing reaction.

12. The alternating color fabric of claim 1, wherein the alternating color fabric has a color rendering variable area of 2% to 40% after water washed for 20 cycle times.

13. The alternating color fabric of claim 1, wherein the alternating color fabric has a color rendering variable area of 2% to 40% following the AATCC 162-2002 Test Method.

14. The alternating color fabric of claim 1, wherein the hydrophilic resin layer has a pattern that is hollow type and is formed continuously.

15. The alternating color fabric of claim 1, wherein the hydrophilic resin layer has a plurality of solid type or hollow type discontinuous patterns, and the solid type or hollow type discontinuous patterns are dots, lines, stripes, squares, circles, ellipses, polygons, irregular patterns, or combinations thereof.

16. The alternating color fabric of claim 1, wherein the hydrophilic resin layer presents a third color, and the third color is different from the primary color.

17. The alternating color fabric of claim 1, wherein the hydrophilic resin layer presents a third color, and the third color is different from the secondary color.

* * * * *